US006325542B1

(12) United States Patent
Komatsu

(10) Patent No.: US 6,325,542 B1
(45) Date of Patent: Dec. 4, 2001

(54) PACKAGE BAG AND PACKAGING DEVICE

(75) Inventor: Shinji Komatsu, Tokyo (JP)

(73) Assignee: Komatsu Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/432,276

(22) Filed: Nov. 2, 1999

(30) Foreign Application Priority Data

Jan. 19, 1999 (JP) ..... 11-011155

(51) Int. Cl.[7] ..... B65D 33/00
(52) U.S. Cl. ..... 383/210
(58) Field of Search ..... 383/210, 211, 383/93

(56) References Cited

U.S. PATENT DOCUMENTS

| | | | | |
|---|---|---|---|---|
| 3,120,336 | * | 2/1964 | Whatley, Jr. | 383/210 |
| 3,189,702 | * | 6/1965 | Wall et al. | 383/210 X |
| 3,256,981 | * | 6/1966 | Kurtz | 383/210 X |
| 3,552,638 | * | 1/1971 | Quackenbush | 383/210 X |
| 3,854,653 | * | 12/1974 | Engelsberger | 383/210 |
| 4,411,365 | * | 10/1983 | Horikawa et al. | 383/211 X |
| 4,471,875 | * | 9/1984 | Hain et al. | 383/211 |
| 4,539,793 | * | 9/1985 | Malek | 383/210 X |
| 4,872,556 | * | 10/1989 | Farmer | 383/210 X |
| 4,956,212 | * | 9/1990 | Bekele | 383/210 X |
| 5,118,203 | * | 6/1992 | Andronico | 383/61 |

FOREIGN PATENT DOCUMENTS

| | | | | |
|---|---|---|---|---|
| 1201748 | * | 9/1965 | (DE) | 383/93 |
| 2 122 166 | * | 1/1984 | (GB) | 383/210 |

* cited by examiner

*Primary Examiner*—Jes F. Pascua
(74) *Attorney, Agent, or Firm*—Oblon, Spivak, McClelland, Maier & Neustadt, P.C.

(57) ABSTRACT

A package bag in a rectangular-like shape for enclosing an object to be packed W, which package bag is configured by a film F having a sealant layer 20 to be fusion-bonded so as to cause interfacial peeling, ply separation, or cohesive failure, and thermally sealed portions provided in at least three sides or four sides 3 in a state enclosing the object to be packed in an inside of the package bag, wherein at least one of the thermally sealed portions 4 along one of the sides is a strippable seal 8*a*, which is associated with an unsealed portion 8 as stripping margins positioned between the strippable seal 8*a* and an film edge 6; and the strippable seal 8*a* is formed in at least a part of the one of the thermally sealed portions 4 to be in a wave-like shape or in a V-like shape protruding toward the film edge 6.

12 Claims, 33 Drawing Sheets

PACKAGE BAG AND PACKAGING DEVICE

BACKGROUND OF THE INVENTION

1. Field of the Invention

The present invention relates to a package bag enclosing various objects to be packed, particularly hermetically enclosing foods and seasonings, and also relates to a packaging device, which continuously form such a package bag while enclosing the objects to be packed in the package bag.

2. Discussion of Background

A conventional technique discloses a rectangular package bag, made of a fusion-bondable film, in which an object to be packed is enclosed by thermally sealed portions, provided along three sides or four sides, under a state that the object to be packed is enclosed in an inside of the package bag.

When a sealant layer, which is fusion-bonded so that interfacial peeling, ply separation, or cohesive failure can occur, is formed in an inside of the film configuring this kind of the package bag, it is possible to take the object to be packed out of the package bag by pulling portions of the film on both sides of the package bag so as to break the thermally sealed portion without cutting the package bag.

However, even though the sealant layers, thermally sealed so as to occur the interfacial peeling or the like, are provided in the inside of the film configuring the package bag so that the sealant layer of a film forming a surface of the package bag and the sealant layer of a film forming another surface of the package bag are fusion-bonded in the thermally sealed portion, a sufficient force should be applied to open the package bag since there is a tendency that a tensile force to the films is uniformly applied to entirely of the thermally sealed portion, which is simply formed. Although it is possibly to adopt a method of forming the thermal seal so as to cause the interfacial peeling or the like with a relatively small force, it is difficult to stably maintain an enclosed state of the object to be packed.

SUMMARY OF THE INVENTION

It is an object of the present invention to solve the above-mentioned problems inherent in the conventional technique and to provide a package bag, which can be relatively easily opened by breaking a thermally sealed portion of the package bag upon application of a tensile force in directions of separating both surfaces of the package bag without deteriorating an enclosed state of an object to be packed.

Another object of the present invention is to provide a packaging device, which continuously forms such a package bag while successively enclosing the object to be packed into the package bag.

According to a first aspect of the present invention, there is provided a package bag, which is configured by a film including a sealant layer, provided in an inside of the film so as to occur interfacial peeling, ply separation, or cohesive failure, wherein the package bag is in a rectangular shape while enclosing the object to be packed by forming thermally sealed portions in, at least, three sides or four sides under a state that the object to be packed is enclosed in an inside of the package bag, wherein at least one of the thermally sealed portions along at least one of sides of the package bag is a strippable sealed portion, which is formed in a wave-like shape in a part of an edge of the sealed portion directed to a film edge or in a V-like shape protruding toward the film edge under a state that an unsealed portion, as stripping margins, is left between the film edge and the strippable sealed portion in the at least one side.

According to such a structure, it is possible to pull film portions on the both sides of the package bag in the directions of separating the film portions by picking the stripping margins formed in the side of the package bag, which side is provided with the strippable sealed portion.

When the film portions are pulled as such, the tensile force is firstly concentrated on peaks of the wave-like shape or the V-like shape in the edge of the strippable sealed portion, whereby a part of the strippable sealed portion is broken by the interfacial peeling, the ply separation, or the cohesive failure with a relatively small tensile force. Accordingly, once the part of the strippable sealed portion is broken, the other part is easily and continuously broken from the firstly broken portion to the opposite side by a continuous application of a tensile force.

In this package bag according to the present invention, the films are easily separated to an extent necessary for taking out the object to be packed enclosed in the package bag by relatively easily destroying a sealed condition of the side, provided with the strippable sealed portion of the package bag in a rectangular-like shape upon a pulling operation with the stripping margin picked.

According to a second aspect of the present invention there is provided a packaging device for continuously forming package bags, enclosing objects to be packed, by continuously providing first thermally sealed portions along with a conveying direction of a film, wherein the film is a continuous film, having a sealant layer to be fusion-bonded on a surface thereof so as to occur interfacial peeling, ply separation, or cohesive failure, which film is conveyed and doubled toward the sealant layer, or two sheets of continuous films, respectively having a sealant layer to be fusion bonded on a surface thereof so as to occur the interfacial peeling, the ply separation, or the cohesive failure, the two sheets of films are conveyed in a state that the sealant layers face each other and provided with second thermal seals in directions perpendicular to the conveying direction with predetermined intervals for enclosing the objects to be packed between the adjacent two second thermal seals comprising: a pair of thermal rolls respectively having an annular protrusion for providing the first thermally sealed portions on the film, transferred between the pair of thermal rolls, wherein the annular protrusion of at least one of the thermal rolls is a rib-like protrusion, which is pressed on the film to form an unsealed portion between an edge of the film and the first thermally sealed portion in the conveying direction of the film and formed in a substantially wave-like shape or a substantially zigzag-like shape along a rotating direction of the thermal roll, or a rib-like protrusion for making a side edge of the film like a zigzag, which rib-like protrusion is in a substantially wave-like shape or a substantially zigzag-like shape along the rotating direction of the thermal roll.

According to such a structure, it is possible to continuously form the first thermally sealed portions to be in a zigzag belt-like shape or a wave-like belt-like shape by the rib-like protrusion, or is possible to form the edge of the sealed portion on the side of the film edge along with the conveying direction of the film to be in a V-like shape or a wave-like shape, wherein such is realized under a state that the unsealed portion between the first thermally sealed portion and the film edge are formed along the conveying direction of the film.

By providing the second thermally sealed portion in the film having the first thermally sealed portion, the package bags with these inner spaces sealed are continuously formed by the first thermally sealed portions in the conveying direction of the film and the pair of second thermally sealed portions in a direction perpendicular to the conveying direction.

As a result, according to the packaging device according to the present invention, it is possible to continuously and appropriately form the package bags having the first thermally sealed portion in the wave-like belt-like shape or the zigzag belt-like shape, which can be easily pulled for separating these on the both surfaces of the package bags via the unsealed portion as the stripping margins and easily broken by causing the interfacial peeling or the like by the pull or those having the first thermally sealed portion of which edge on the side of the film edge being along the conveying direction of the film, is the V-like shape or the wave-like shape.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A detailed explanation will be given of preferred embodiment of the present invention in reference to FIGS. 1 through 33 as follows, wherein the same numerical references are used for the same or similar portions and description of these portions is omitted.

In the first place, an embodiment of a package bag H according to the present invention will be described in reference of FIGS. 1 through 11.

Figure 5:
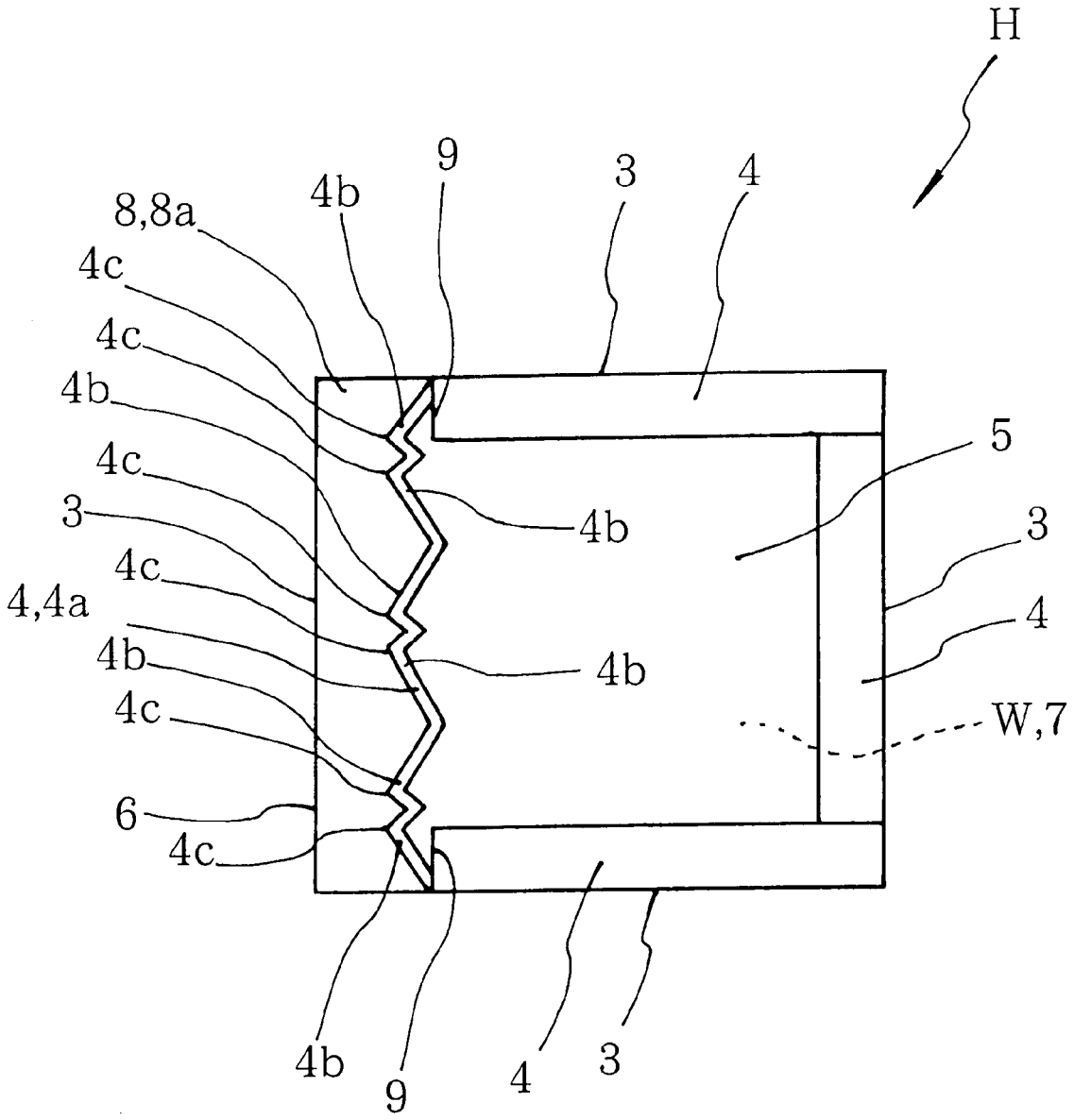
FIG. 5 is a schematical view illustrating a structure of the package bag W.
Figure 6:
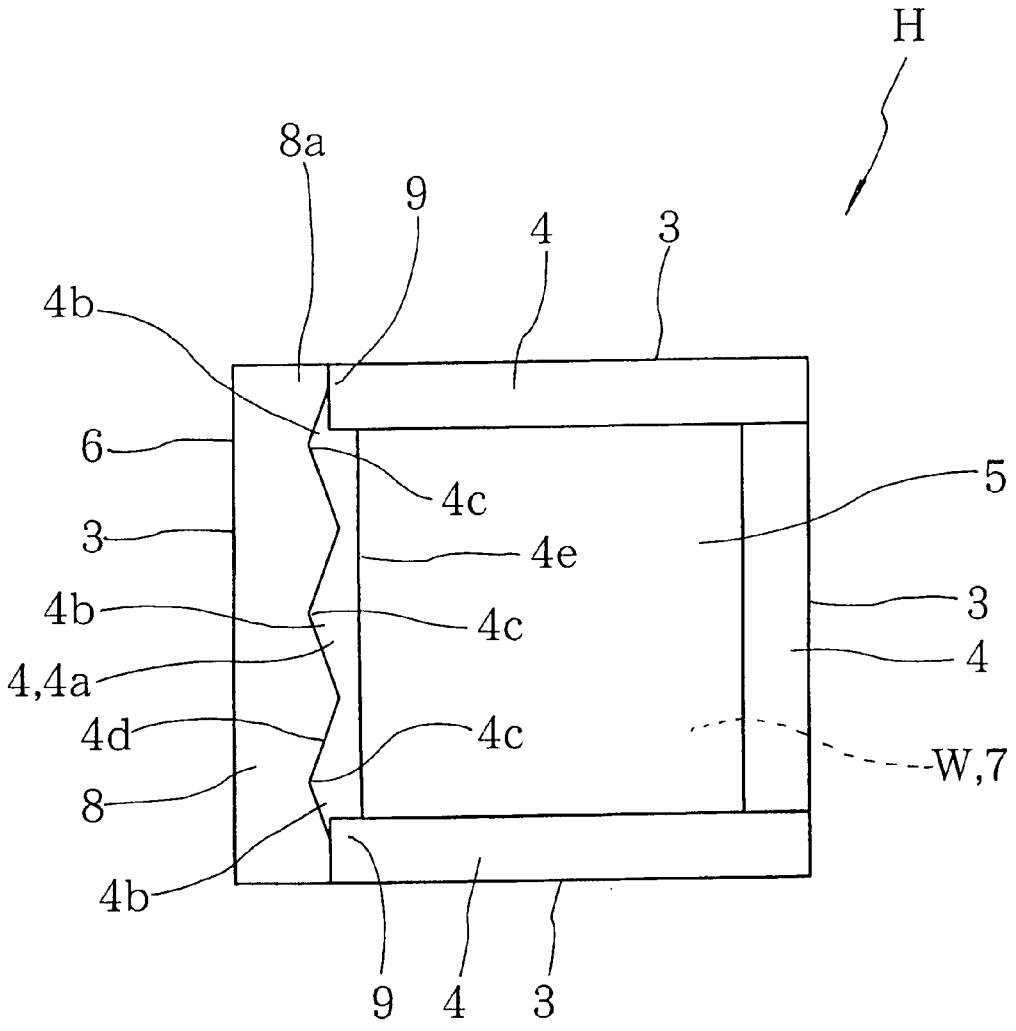
FIG. 6 is a schematical view illustrating a structure of the package bag W.
Figure 7:
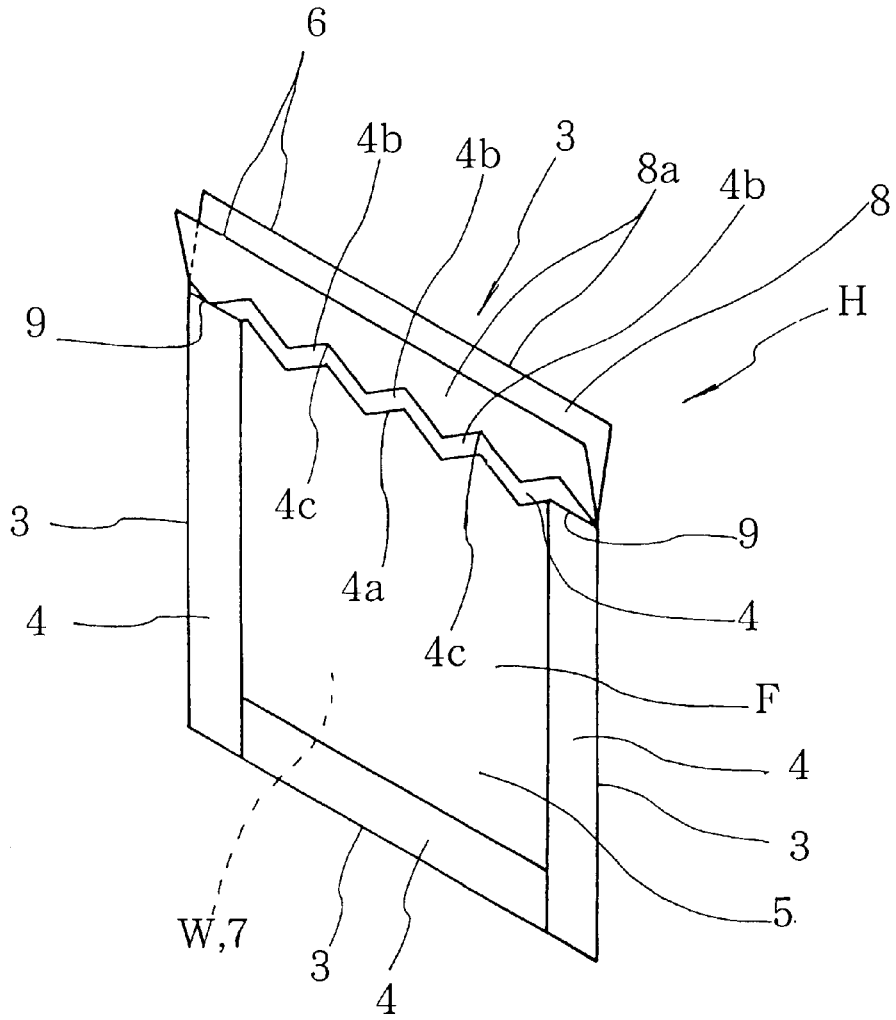
FIG. 7 is a perspective view schematically illustrating the structure of the package bag.
Figure 8:
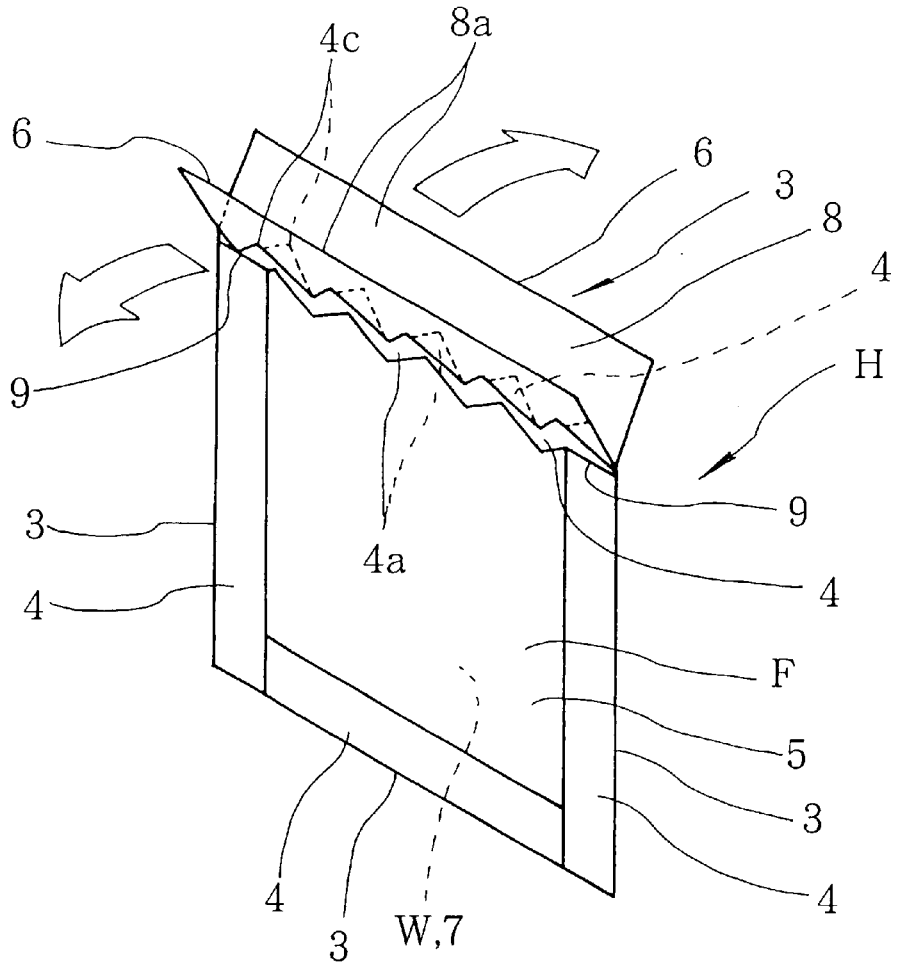
FIG. 8 is a perspective view schematically illustrating the structure of the package bag.
Figure 9:
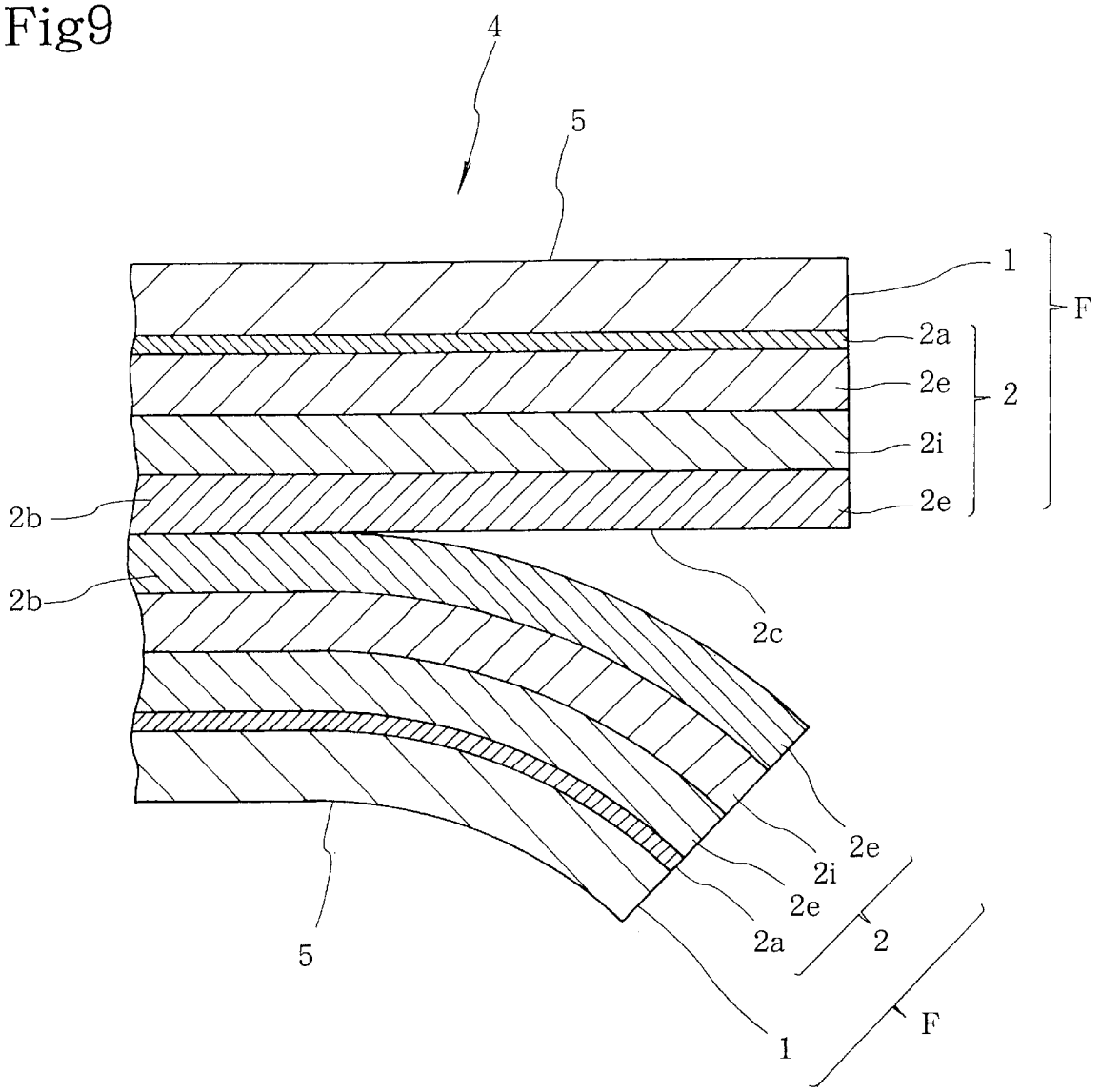
FIG. 9 is a cross-sectional view of an important portion of a package bag W.
Figure 10:
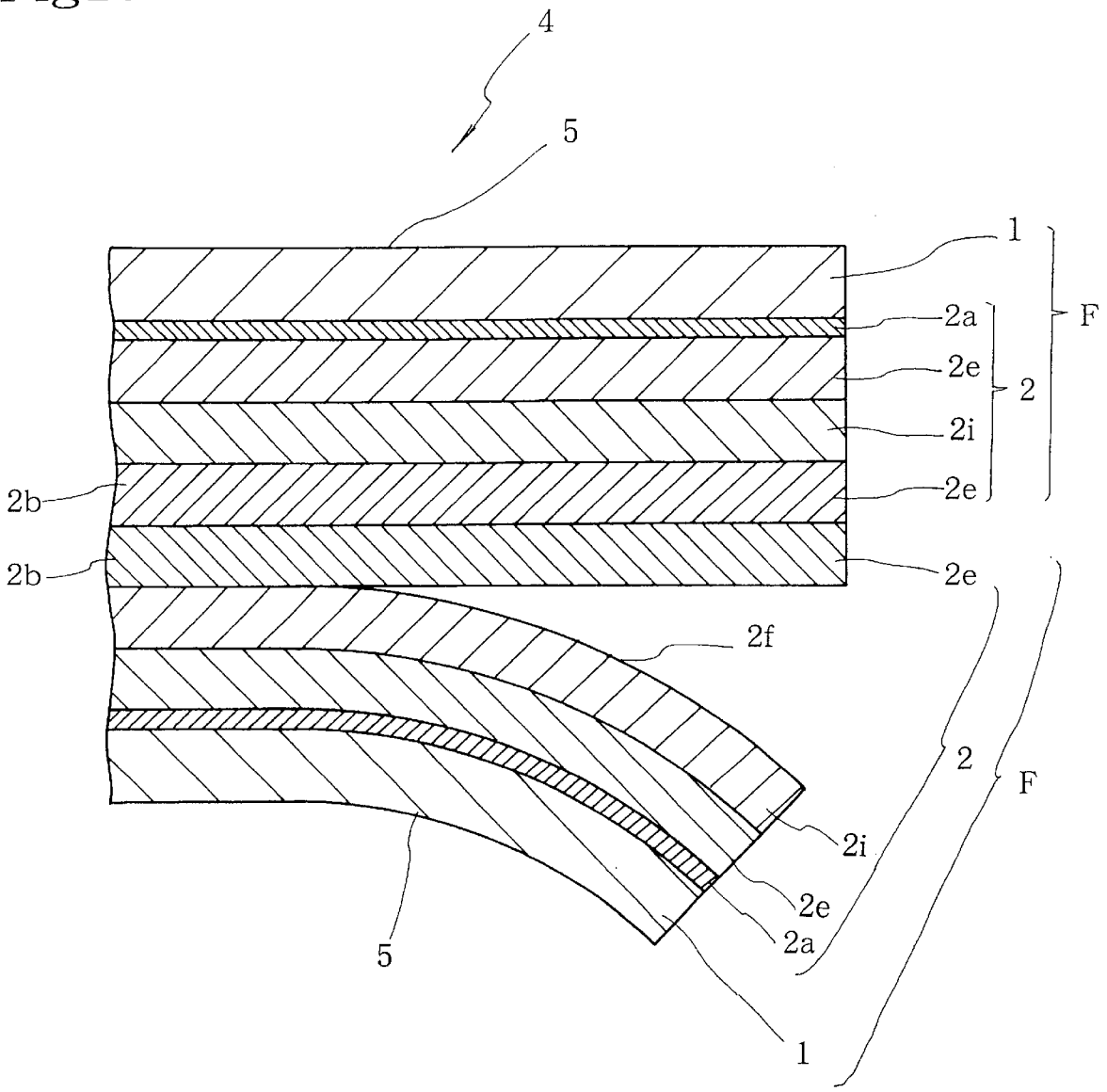
FIG. 10 is a cross-sectional view of an important portion of a package bag W.
Figure 11:
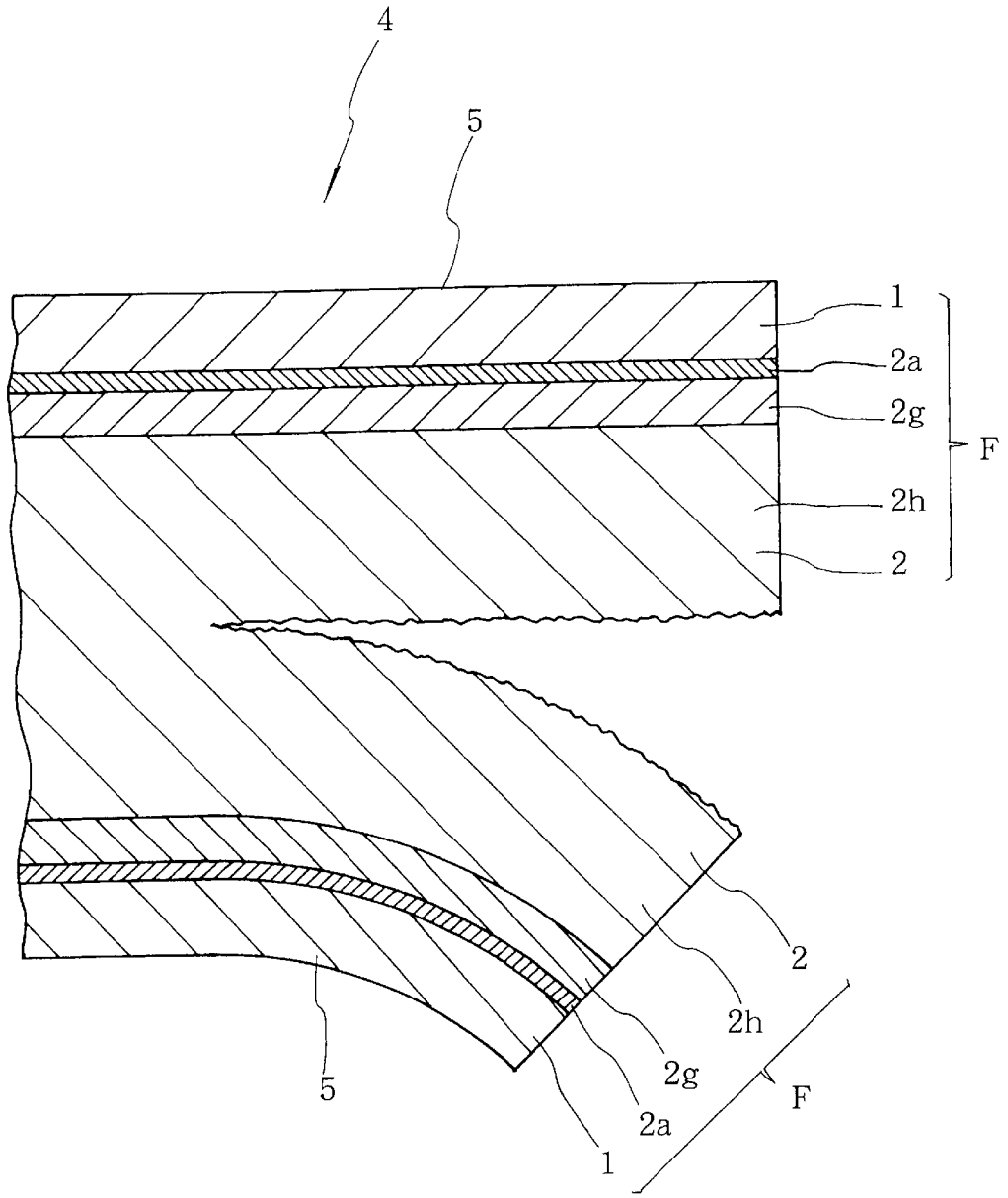
FIG. 11 is a cross-sectional view of an important portion of a package bag W.

FIGS. 1 through 6 respectively illustrate various modes of the package bag H according to the embodiment, wherein a shape of a strippable sealed portion 4*a* is changed respectively for the package bags H illustrated in the Figures. FIGS. 7 and 8 are perspective views of the package bag H in the mode illustrated in FIG. 1. In FIG. 8, a state that the film portions 5 on both surfaces of the package bag H are pulled in directions of separating the film portions 5 each other using stripping margins 8*a* is illustrated. FIGS. 9 through 11 are enlarged views illustrating a thermally sealed portion 4 of the package bag H in section when a tensile force is applied as illustrated in FIG. 8. FIG. 9 illustrates a state of interfacial peeling. FIG. 10 illustrates a state of ply separation. FIG. 11 illustrates a state of cohesive failure.

The package bag H according to the embodiment is formed by the films F, respectively having a sealant layer 2 in an inside thereof, wherein the package bag is in a rectangular bag-like shape; thermally sealed portions 4 are provided along four sides 3, 3, . . . ; and an object to be packed W is hermetically enclosed in an inside of the package bag by the thermally sealed portions 4.

More specifically, the film 5 on one side of the package bag H and the film 5 on the other side of the package bag H are integrated by the thermally sealed portion 4 so as to form an area 7, enclosing the object to be packed W, in a center of the package bag H.

In case that the package bag H is made of a doubled material film by doubling it so that the sealant layers 2 face each other, the film portions 5, 5 on both surfaces of the package bag are secured at edges of a doubled side of the material film and an opposite side thereto by providing the thermally sealed portions 4. Additionally, the film portions 5, 5 on the both surfaces are further secured by two thermally sealed portions 4, 4, with an interval in directions perpendicular to the above doubled side, to form the package bag H. The object to be packed W is enclosed into the package bag H, i.e. three-sided sealed bag, in a process of forming the thermally sealed portions 4, 4, . . . Further, when the package bag H is made of thus doubled material film, it is not always necessary to form the thermally sealed portion 4 along the doubled side edge.

In case that the package bag H is formed by two material films so that sealant layers 2 face each other, film portions 5, 5 on both surfaces of the package bag are secured at side edges of the material films by providing two thermally sealed portions 4, 4, . . . , and the film portions 5, 5 on the both sides are secured at the two positions by providing thermally sealed portions 4, 4 in directions perpendicular to the side edges with an interval, whereby the package bag H, i.e. a four-sided sealed bag, is formed. In this case, the object to be packed W is enclosed in the package bag H in a process of forming the thermally sealed portions 4, 4, . . . .

In both of the cases of the three-sided sealed bag and the four-sided sealed bag, a single or a plurality of thermally sealed portions may be additionally formed in a middle of the package bag to form the package bag H with a plurality of enclosing spaces 7, 7, . . . , wherein two kinds or more of objects to be packed W can be enclosed in the package bag H.

In the embodiment, the films F forming the package bag H are thermally sealed by the sealant layers 2 so as to occur the interfacial peeling, the ply separation, or the cohesive failure at the thermally sealed portions 4, 4, . . . .

For example, the film causing the interfacial peeling is obtained by integrally forming the sealant layer 2, fabricated by three layers of an inextensible plastic layer 2*e*, an adhesive film layer 2*i*, and an inextensible plastic layer 2*e* in an order from an inside to an outside on a surface of a base film formed by stretching a plastic via an adhesive layer 2*a*. Further, by thermally sealing at a temperature of avoiding to firmly fusion-bond a plastic layer 2*b*, provided on an upper surface of the sealant layer of the film portion 5 on one side of the package bag, to a plastic layer 2*b*, provided on an upper surface of the sealant layer 2 of the film portion 5 on the other side of the package bag, it is possible to separate the film portions 5, 5 on the both sides of the package bag by pulling the film portions 5, 5 to break the thermally sealed portion 4 at an interface 2*c* between the film portions 5, 5, as illustrated in FIG. 9.

For example, the film causing the ply separation is obtained by integrally providing the sealant layer 2, fabricated by an inextensible plastic layer 2*e*, an adhesive film layer 2*i*, and an inextensible plastic layer 2*e* in an order from an inside to an outside through an adhesive layer 2*a* on one surface of a base film 1, formed by stretching a plastic. By thermally sealing at a temperature of firmly fusion-bonding a plastic layer 2*b*, provided on an upper surface of the sealant layer 2 of the film portion 5 on one surface of the package bag, to a plastic layer 2*b* provided on an upper surface of the sealant layer 2 of the film on the other side of the package bag, the film portions 5, 5 on the both sides of the package bag are separated by pulling the film portions in directions of separating the film portions to break the thermally sealed portion at an interlayer 2*f* between the adhesive film layer 2*i* and the inextensible plastic layer 2*e*, as illustrated in FIG. 10.

For example, the film causing the cohesive failure is obtained by providing an aluminum foil 2*g* on one surface of a base film 1, formed by stretching a plastic, through an adhesive layer 2*a*, and further providing the sealant layer 2 made of a fusion bondable layer, which causes the cohesive layer, on an upper surface of the aluminum foil 2*g*. In this case, it is possible to cause the cohesive failure at the bonding layer 2*h*, fabricating the sealant layer 2 of fusion-bonded film portions 5, 5 by pulling in directions of separating the film portions, whereby the film portions 5, 5 are separated by breaking the thermally sealed portion 4, as illustrated in FIG. 11.

Figure 1:
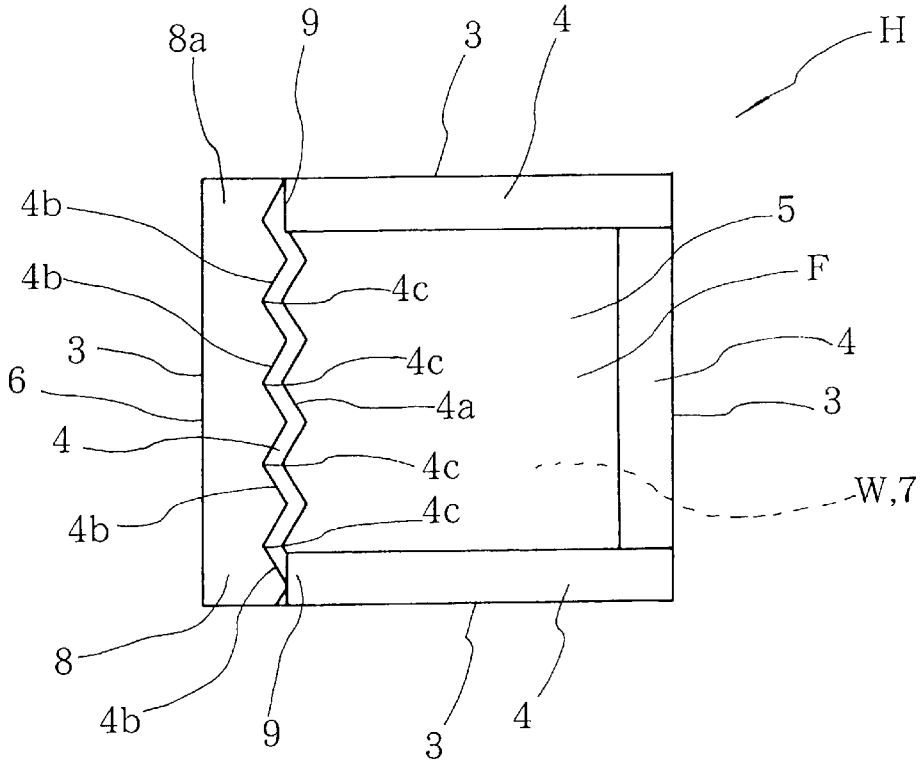
FIG. 1 is a schematical view illustrating a structure of a package bag W.
Figure 2:
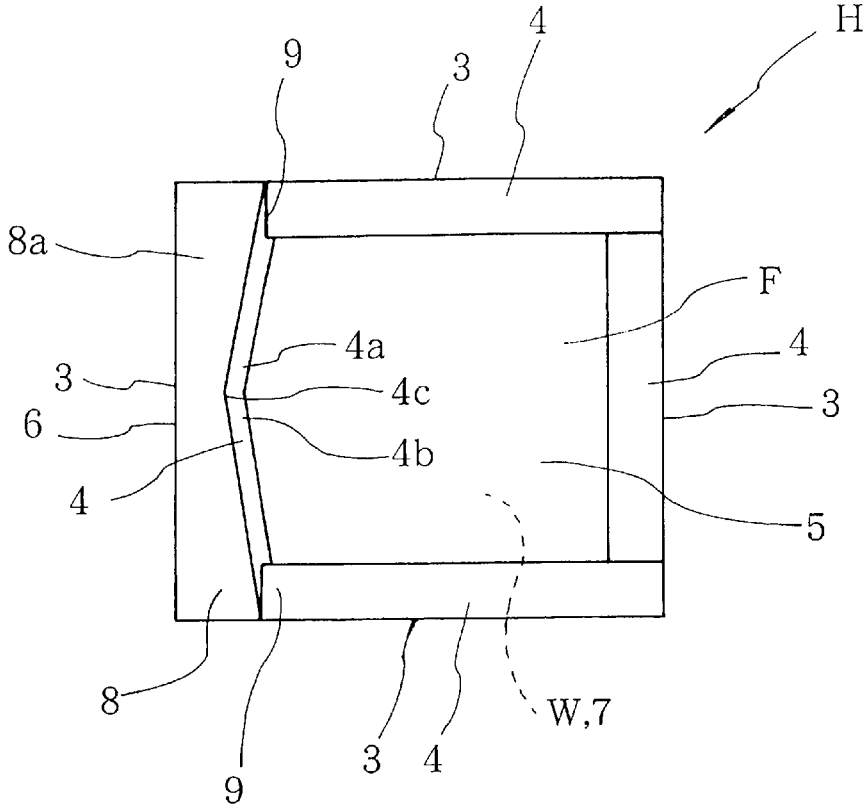
FIG. 2 is a schematical view illustrating a structure of the package bag W.
Figure 4:
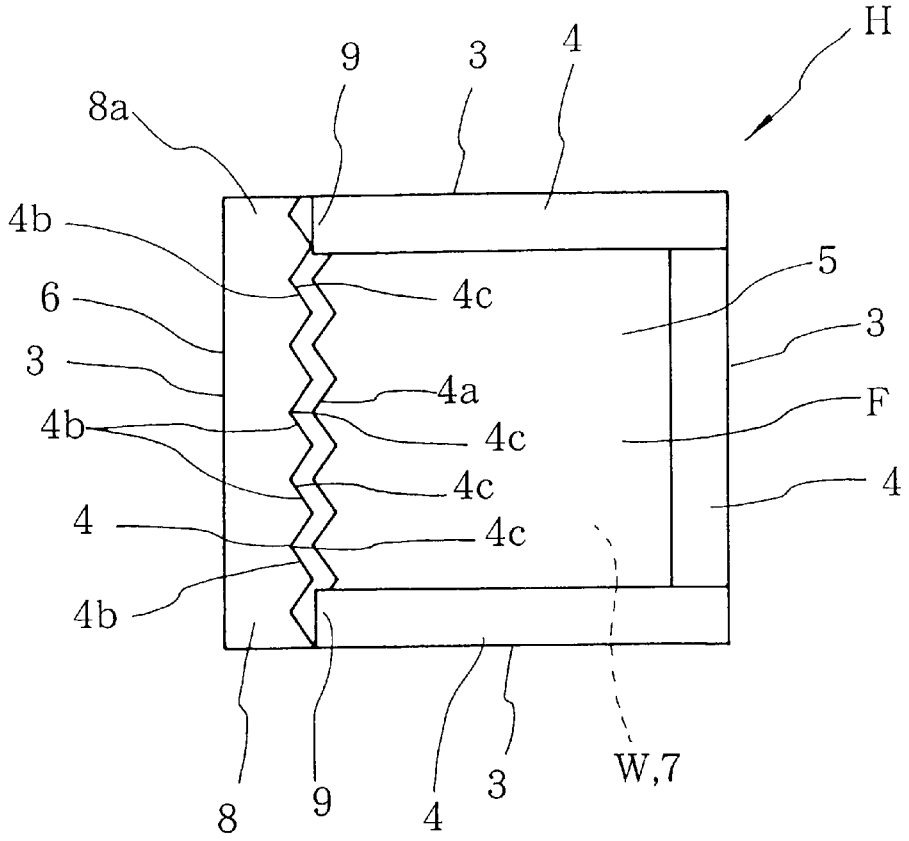
FIG. 4 is a schematical view illustrating a structure of the package bag W.

In the embodiment, the thermally sealed portion 4 in one side 3 of the package bag H in the rectangular shape is formed to be in a wave-like shape along the side 3 with an unsealed portion 8 of stripping margins 8*a* left between a film edge 6 in the side 3 and the thermally sealed portion 4 as illustrated in FIGS. 1, 3, 4, and 5, or to be in a V-like shape protruding toward the film edge as illustrated in FIG. 2. Or, an edge of the sealed portion 4d facing the film edge 6 may be formed in a wave-like shape, wherein an edge of the sealed portion 4*e* opposite to the edge of the sealed portion 4*d* is formed to be straight as illustrated in FIG. 6. Hereinbelow, the thermally sealed portion 4 formed to be in the wave-like shape or the like is referred to as a strippable sealed portion 4*a*.

In other words, the strippable sealed portion 4*a* is formed at a position, where the unsealed portion 8 having a width sufficient for enabling to pick the film edges 6 of the film portions 5, 5 is left in the side 3. The unsealed portion 8 is positioned between the film edges 6 of the film portions 5, 5, which are provided along the side 3, and the strippable sealed portion 4*a*. Further, thermally sealed portions 4, 4, positioned on both sides of the strippable sealed portion 4a, are formed in a straight belt-like shape so that each of the edges 9 thereof is substantially included in a width of the strippable sealed portion 4*a*.

As a result, it is possible to pull the film portions 5, 5 in the directions of separating each other by picking the stripping margin 8*a*, formed in the side 3 having the strippable sealed portion 4*a*. When the film portions are pulled as such, a tensile force is firstly concentrated on peaks of a V-like portion 4*b* of the strippable sealed portion 4*a*, whereby a part of the strippable sealed portion 4*a* is broken by the interfacial peeling, the ply separation, or the cohesive failure with a relatively small tensile force. It is easy to continuously break thus partly broken strippable sealed portion 4*a* from the broken part to the edge by a successive application of the tensile force. Further, it is easy to gradually break the thermally sealed portions 4, positioned on the both sides of the strippable sealed portion 4*a* so as to substantially include the edges 9 within the strippable sealed portion 4*a* from a side of the edges 9 in a longitudinal direction of the thermally sealed portions 4 by the successive application of the tensile force.

In other words, in the embodiment, it is possible to easily separate the film portions 5, 5 to an extent necessary for taking out the object to be packed W, enclosed in the package bag H, by relatively easily breaking the three thermally sealed portions 4, 4, . . . at the side 3 with the strippable sealed portion 4*a* and the sides 3, 3 on both sides of the above side 3 of the package bag H in the rectangular-like shape by picking and pulling the stripping margins 8*a* and separating the film portions 5, 5.

Figure 3:
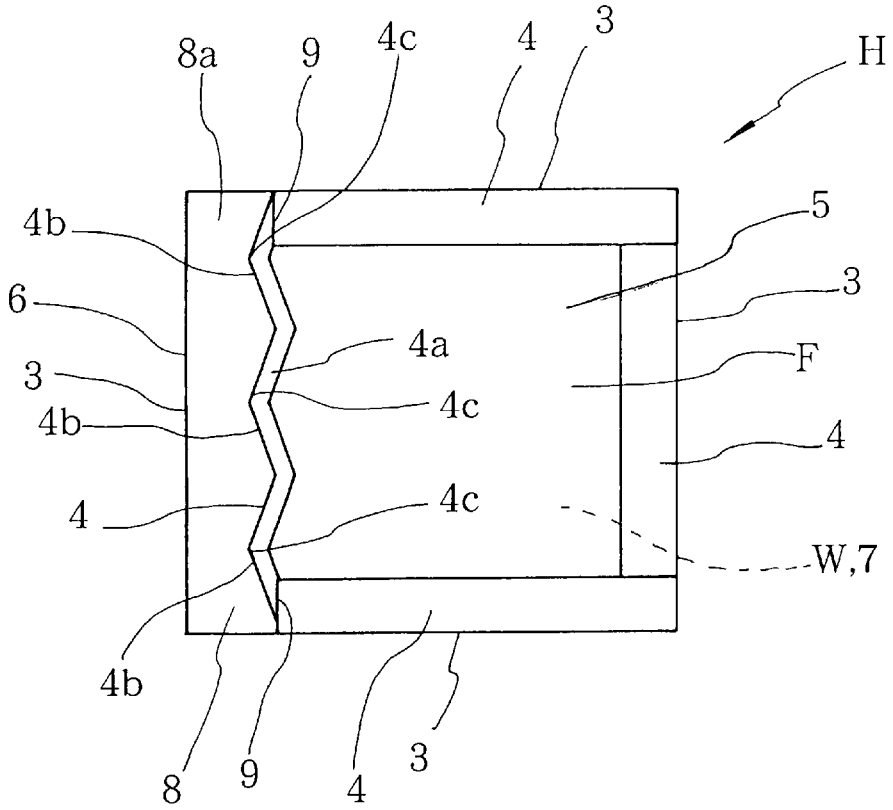
FIG. 3 is a schematical view illustrating a structure of the package bag W.

As illustrated in FIGS. 1, 3, and 4, the number of the V-like portions 4*b* in the strippable sealed portion 4*a*, an interval between the adjacent V-like portions 4*b*, and a shape of the V-like portions 4*b* may be appropriately changed when necessary. Incidentally, as illustrated in FIG. 5, the strippable sealed portion 4*a* may be formed in an irregular wave-like shape such that a plurality of peaks 4*c*, 4*c*, . . . are provided on a protruding side of the V-like portion 4*b*. The strippable sealed portion 4*a* may be formed such that the peaks 4*c* of the like portions 4*b* are radiused.

Further, as illustrated in FIG. 2, the strippable sealed portion 4*a* may be formed in a V belt-like shape, which does not have a bottom and has a single V-like portion 4*b* protruding toward the film edge 5 in the side 3, which single V-like portion 4*b* is provided with the strippable sealed portion 4*a*. Further, as illustrated in FIG. 6, an edge 4*d* of the strippable sealed portion 4*a*, positioned on a side of the film edge 6 in the unsealed portion 8 of the stripping margins 8*a*, may be formed in a wave-like shape and an edge 4*e* of the sealed portion on an inner side of the package bag may be straight, to resultantly make all edges of the thermally sealed portions 4 in an inside of the package bag H. In this case, an outer shape of the object to be packed W, enclosed in the package bag H in a soft condition, is typically formed like a rectangular by hardening the object to be packed.

Stripping margins 8*a* and strippable sealed portions 4*a* may be formed in a plurality of sides 3, 3, . . . of the package bag H. In this case, the package bag H can be easily opened from any of the plurality of sides 3, 3, . . . of the package bag.

The object to be packed W is typically foods such as a plate-like cheese, a bar of sweetened and jellied bean paste, a candy, a minced process flesh, and seasonings such as fermented soybean paste (miso), butter, and oil. However, it is not limited thereto and any matter, required to be enclosed in a film, can be packaged as the object to be packed W.

In the next, an embodiment of the packaging device S according to the present invention will be described in reference of FIGS. 12 through 25.

Figure 12:
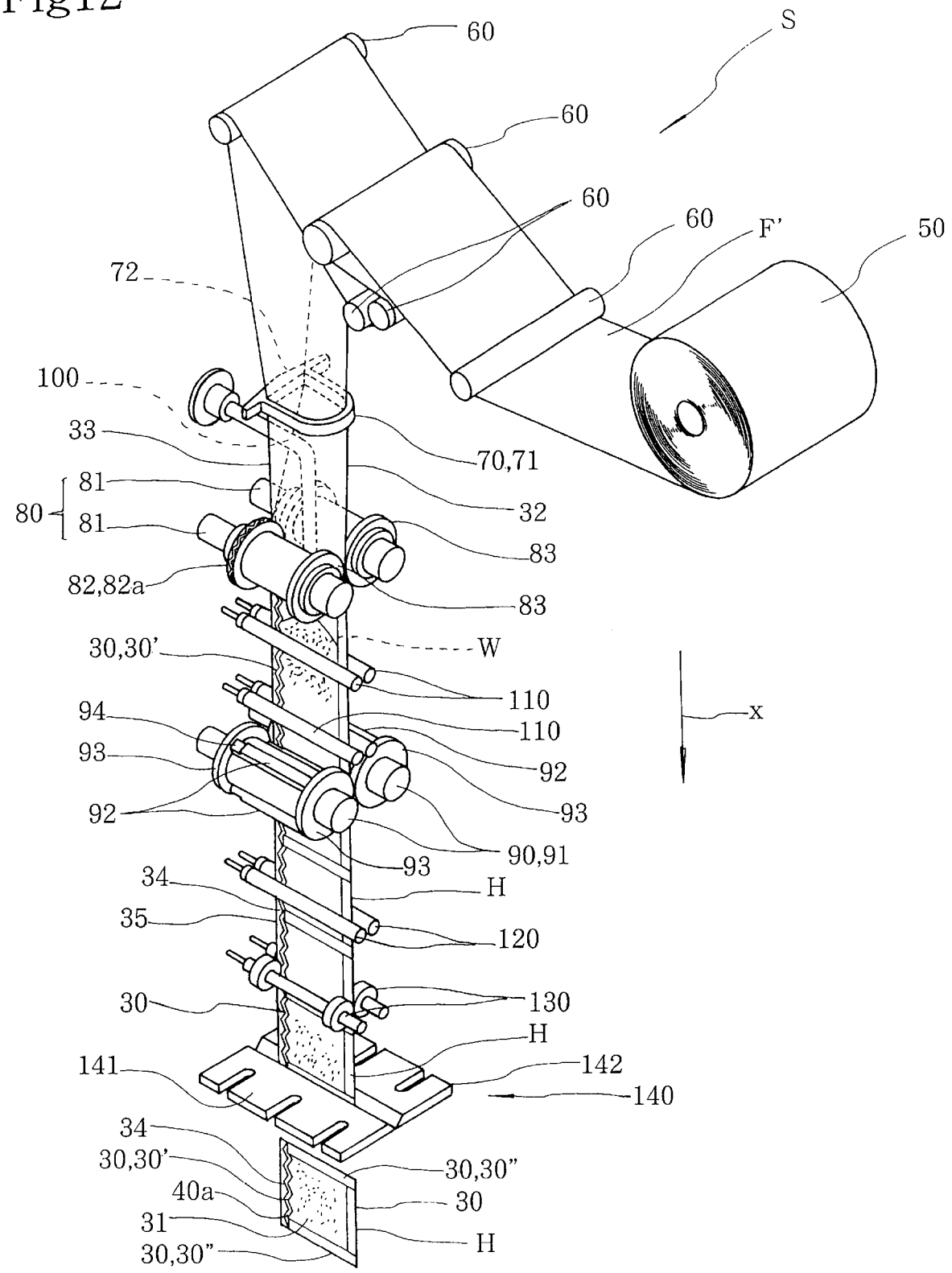
FIG. 12 is a perspective view illustrating a structure of a packaging device S.
Figure 13:
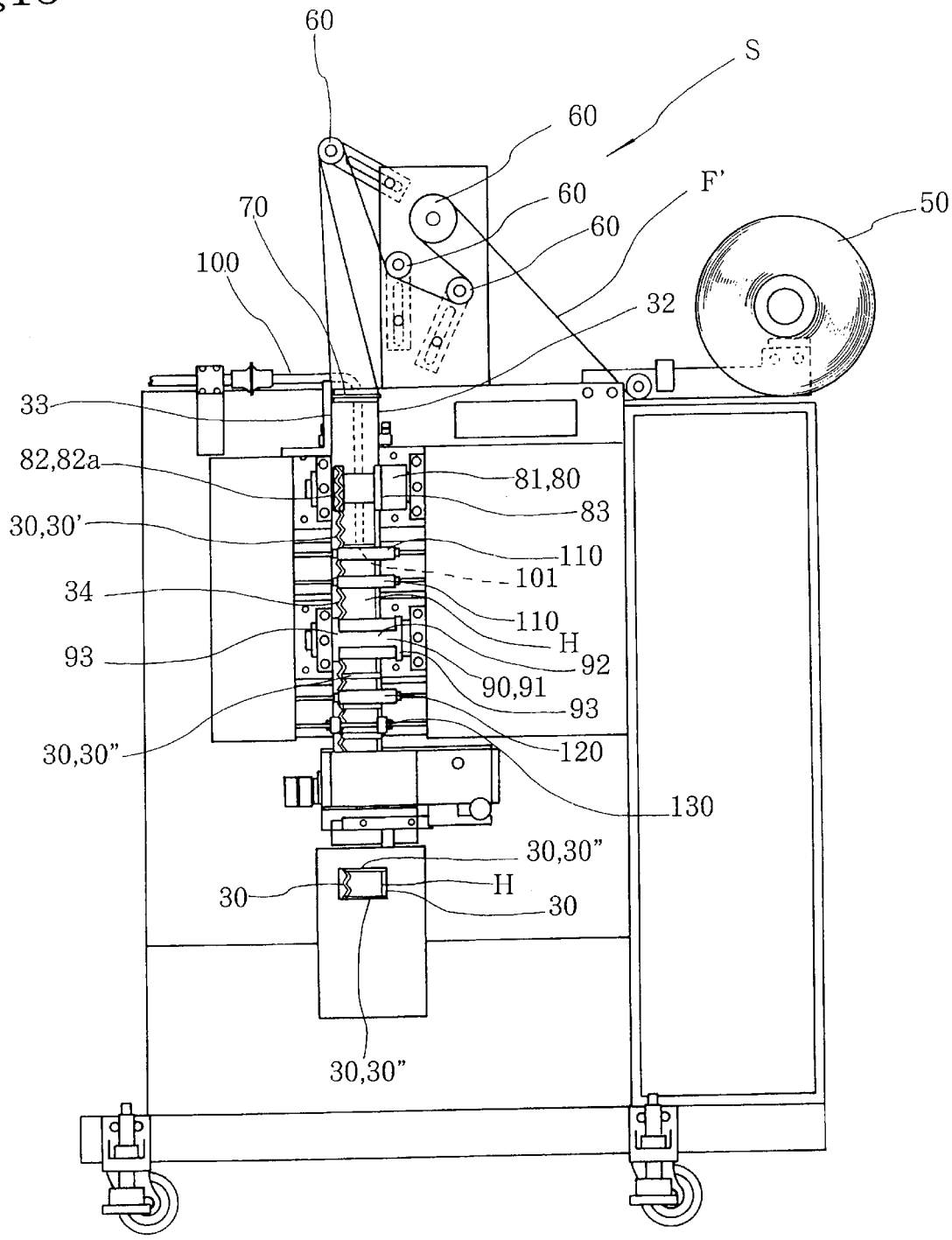
FIG. 13 is a side view illustrating the packaging device S.
Figure 14:
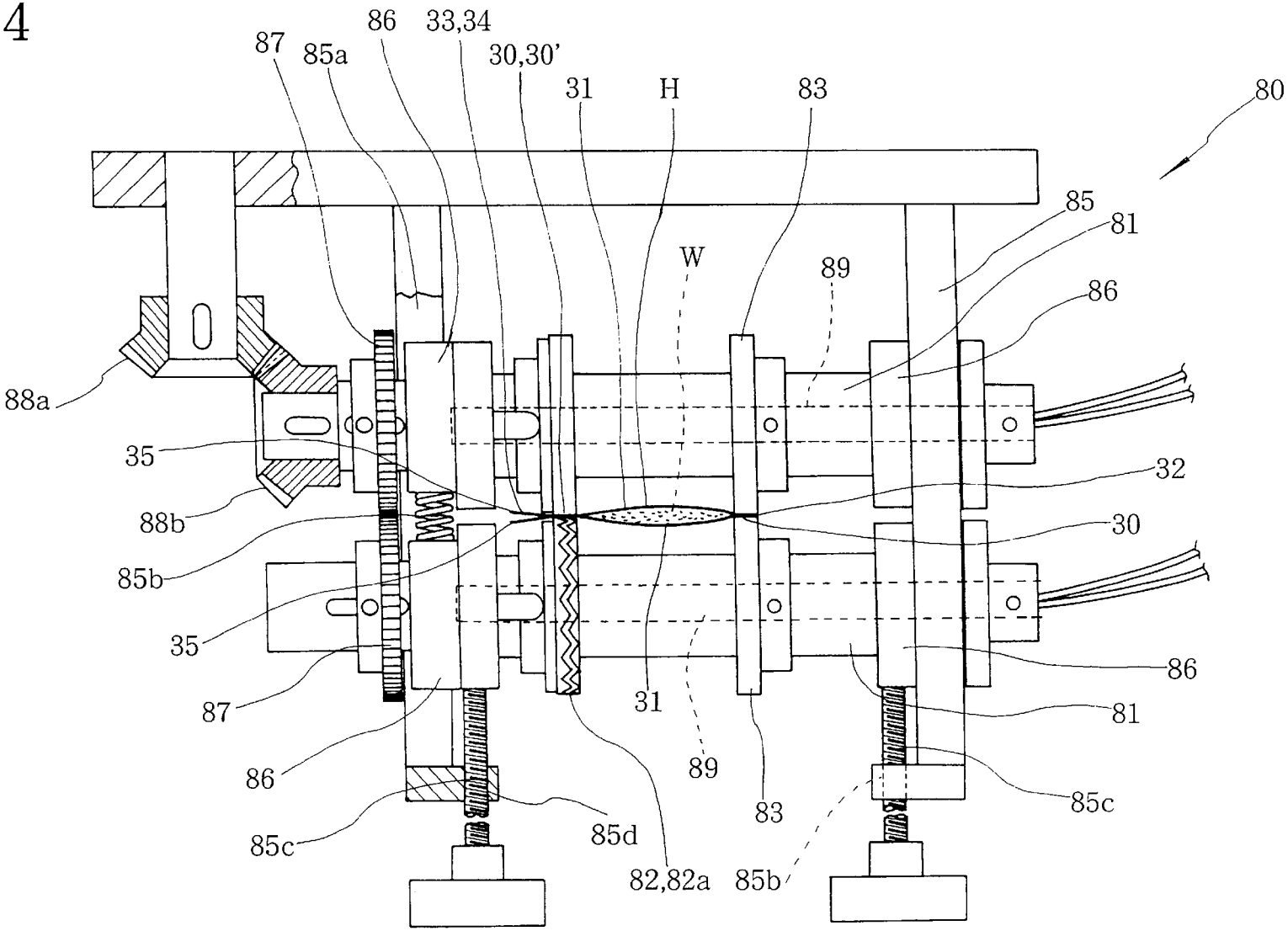
FIG. 14 is a plane view illustrating an important portion of the packaging device S.
Figure 15:
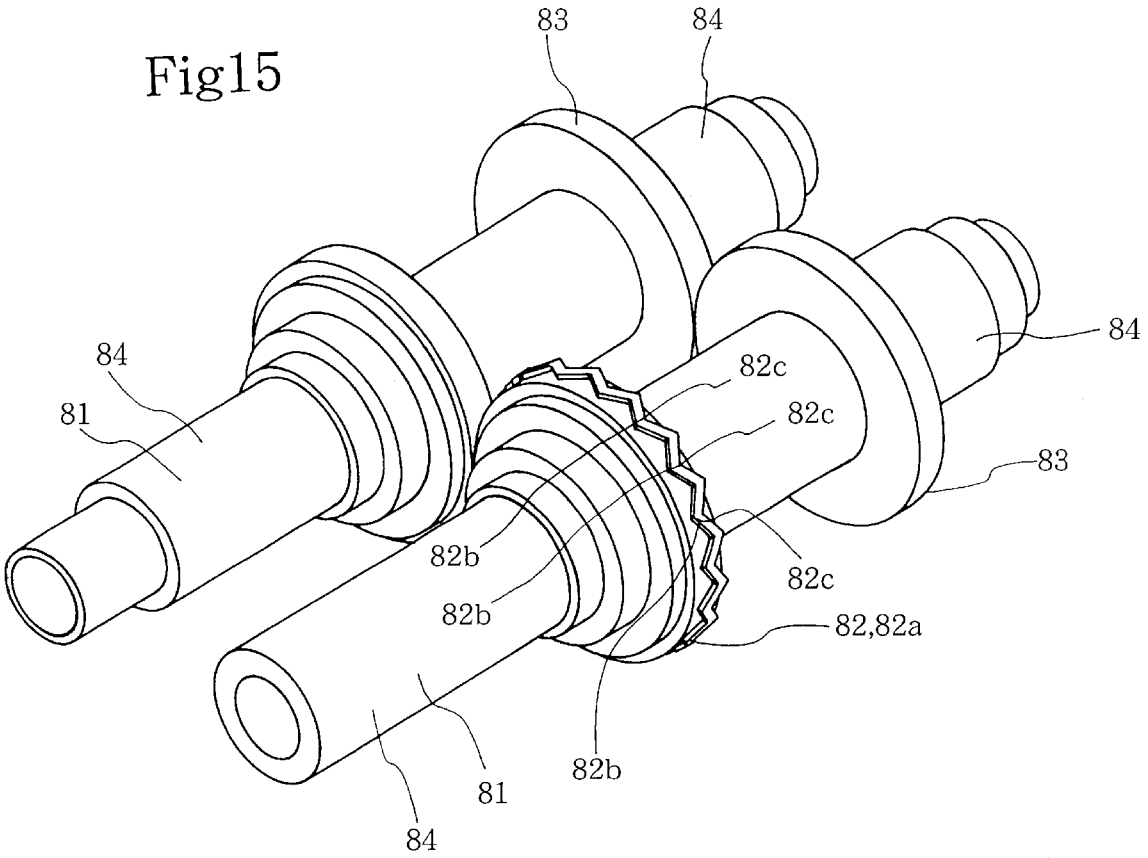
FIG. 15 is a perspective view illustrating a structure of longitudinal thermal rolls 81 constructing the packaging device S.
Figure 16:
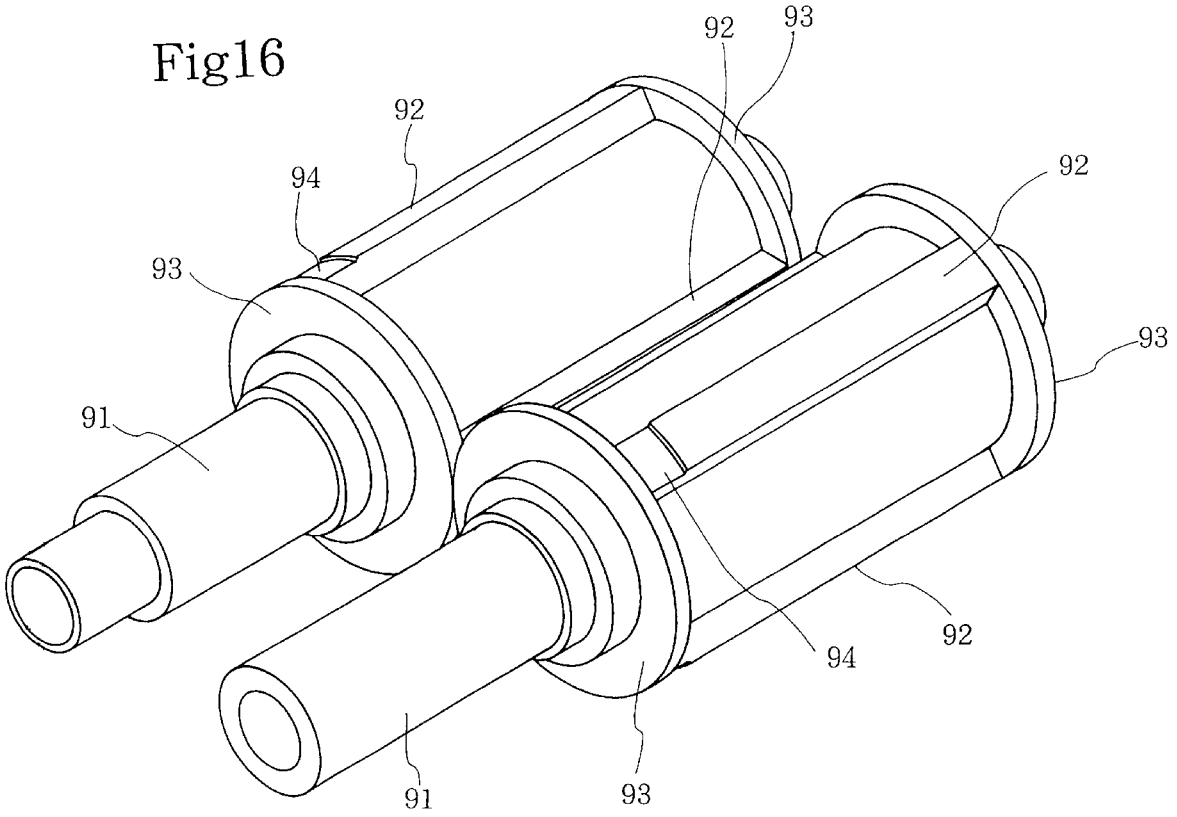
FIG. 16 is a perspective view illustrating a structure of lateral thermal rolls 91 constructing the packaging device S.
Figure 17:
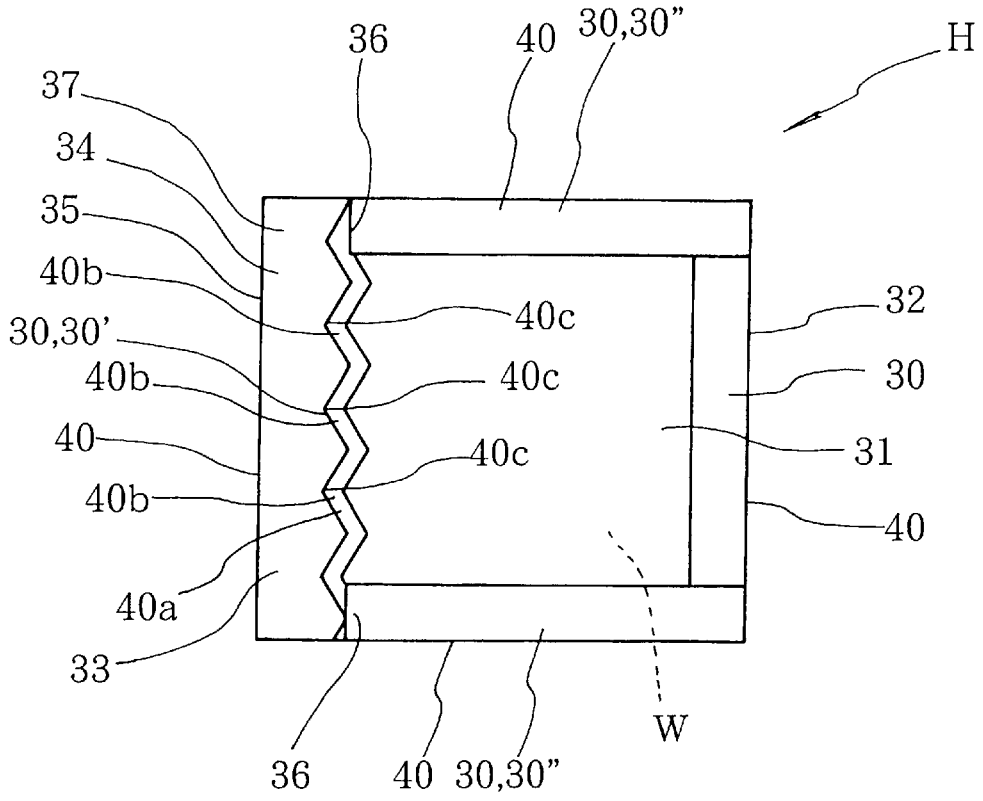
FIG. 17 schematically illustrates a package bag W formed by the packaging device S.
Figure 18:
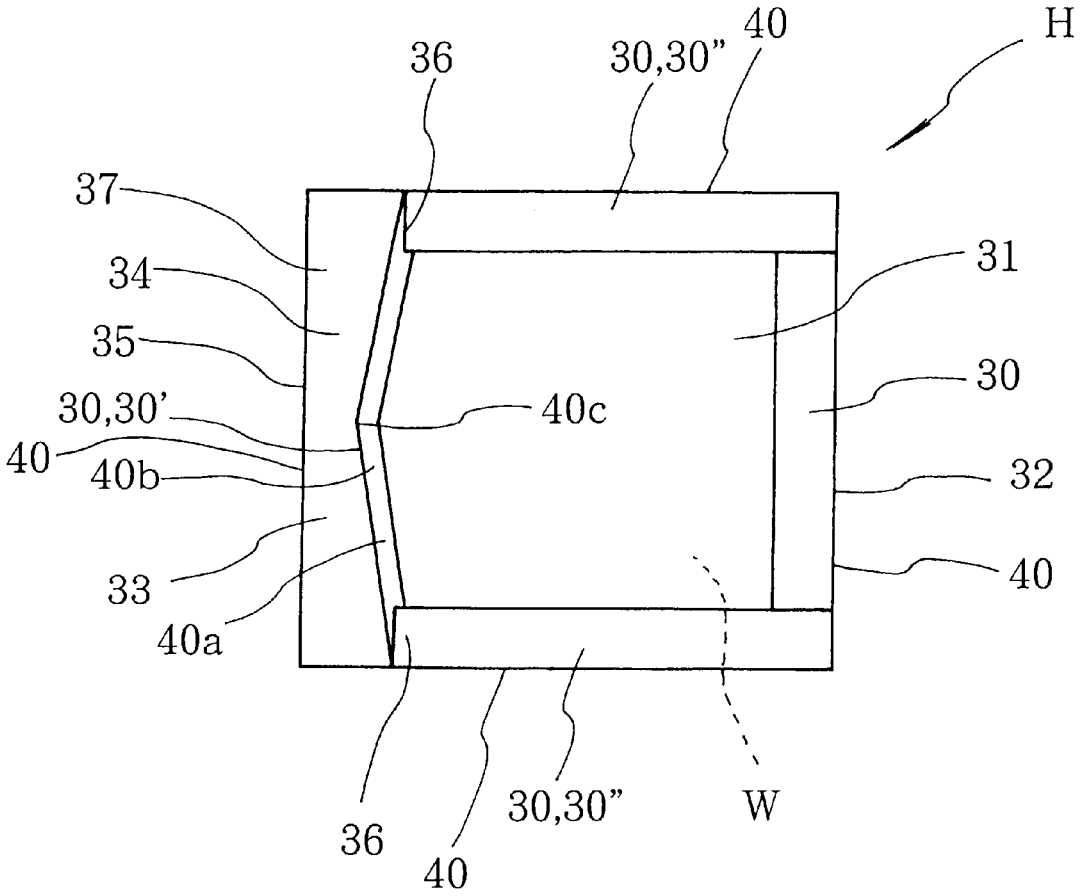
FIG. 18 schematically illustrates the package bag W produced by the packaging device S.
Figure 19:
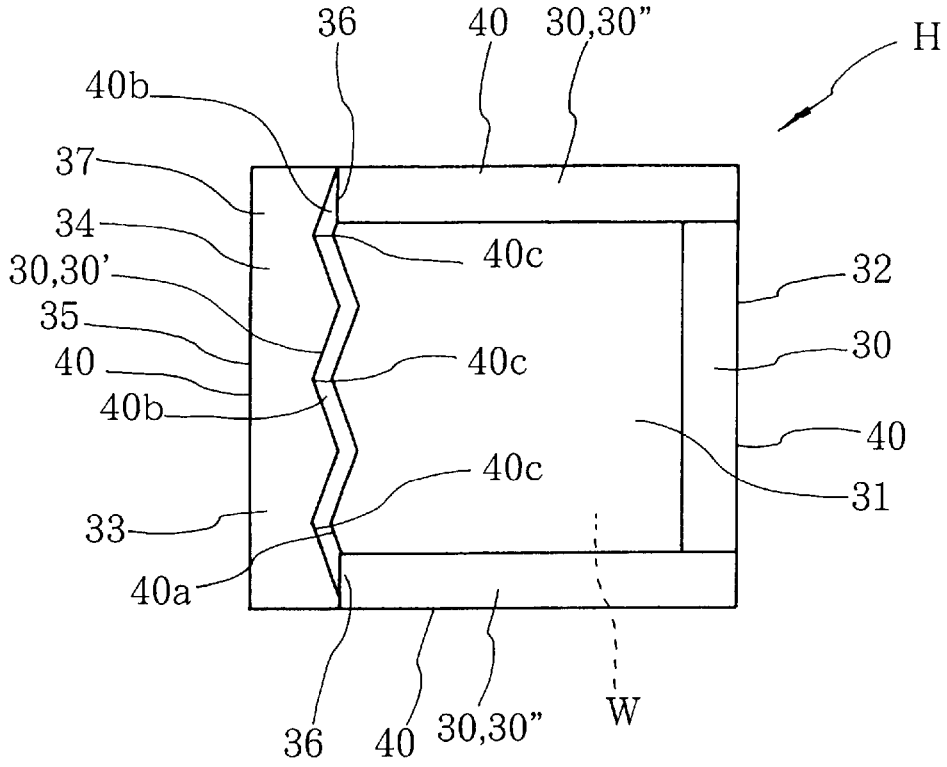
FIG. 19 schematically illustrates the package bag W produced by the packaging device S.
Figure 20:
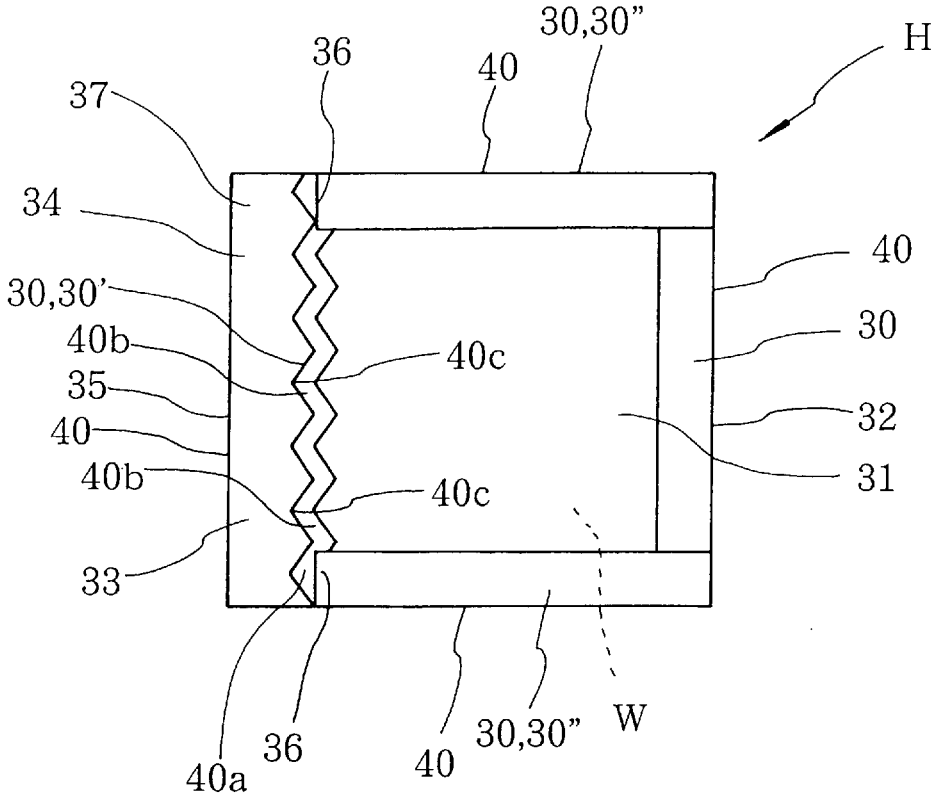
FIG. 20 schematically illustrates the package bag W produced by the packaging device S.

FIG. 12 is a structural perspective view illustrating an important portion of the packaging device according to the embodiment for understanding of an entire structure of the packaging device S. FIG. 13 is a side structural view. FIG. 14 is a plan structural view partly broken for understanding of a structure of a first thermally sealing means 80. FIG. 15 is a perspective structural view illustrating a pair of longitudinal thermal rolls 81, 81, which constitute the first thermally sealing means 80. FIG. 16 is a perspective structural view illustrating a pair of lateral thermal rolls 91, 91, constituting a second thermally sealing means 90.

Figure 21:
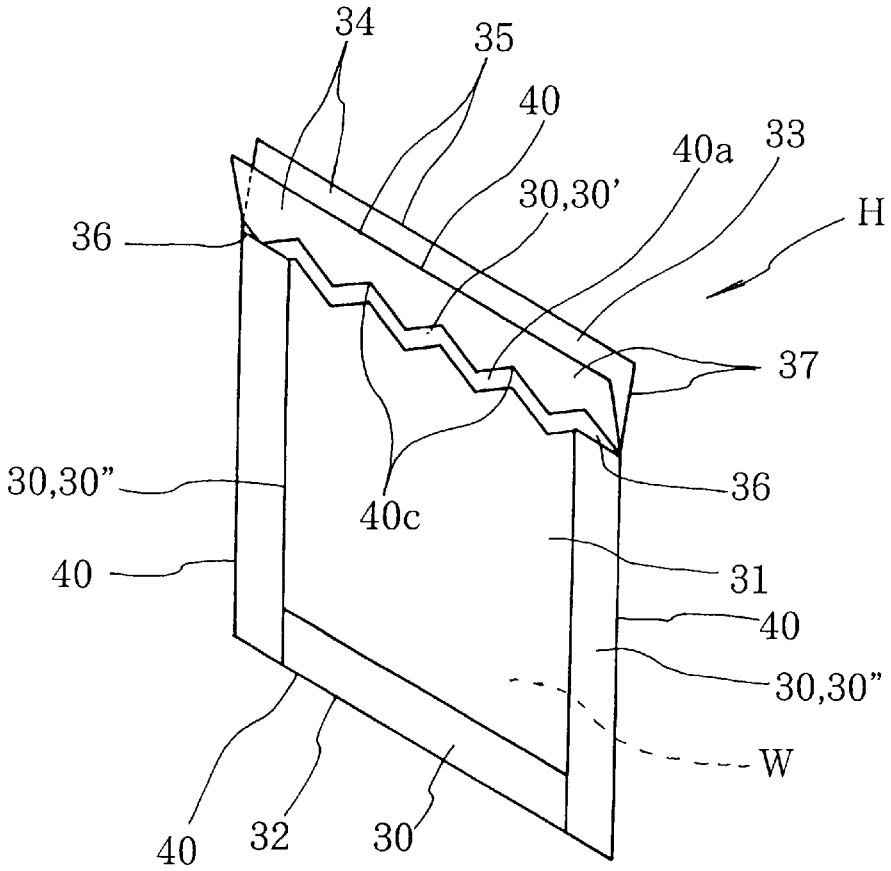
FIG. 21 is a perspective view schematically illustrating the package bag W produced by the packaging device S.
Figure 22:
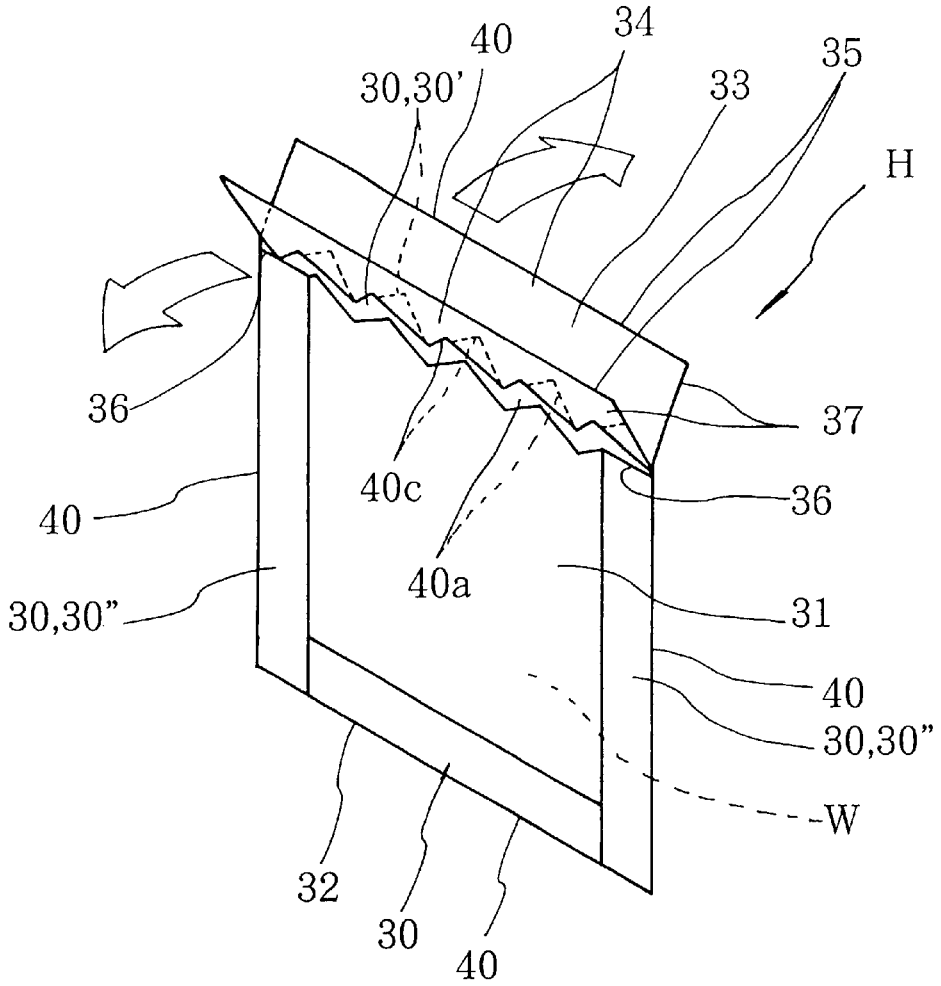
FIG. 22 is a perspective view schematically illustrating the package bag W produced by the packaging device S.
Figure 23:
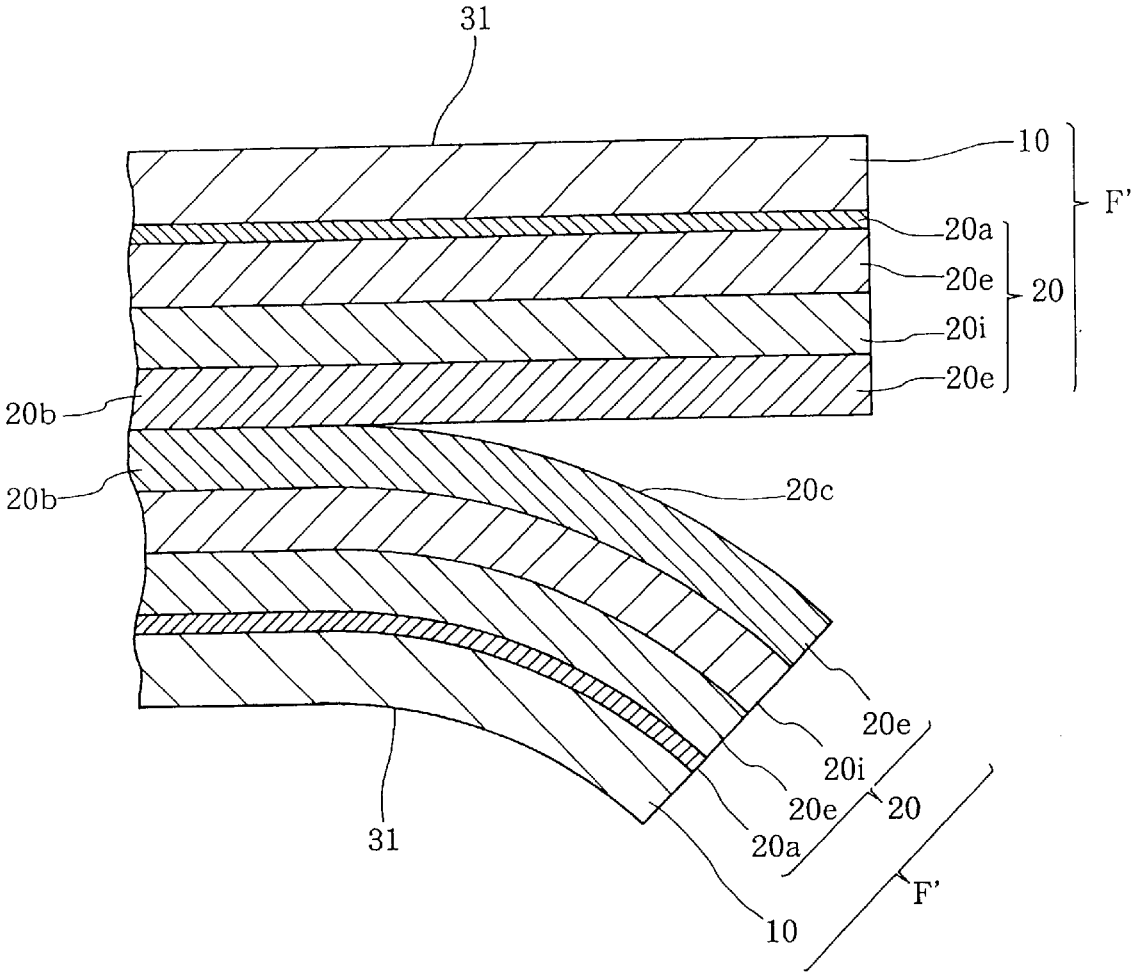
FIG. 23 is a cross-sectional view illustrating an important portion of a package bag W produced by the packaging device S.
Figure 24:
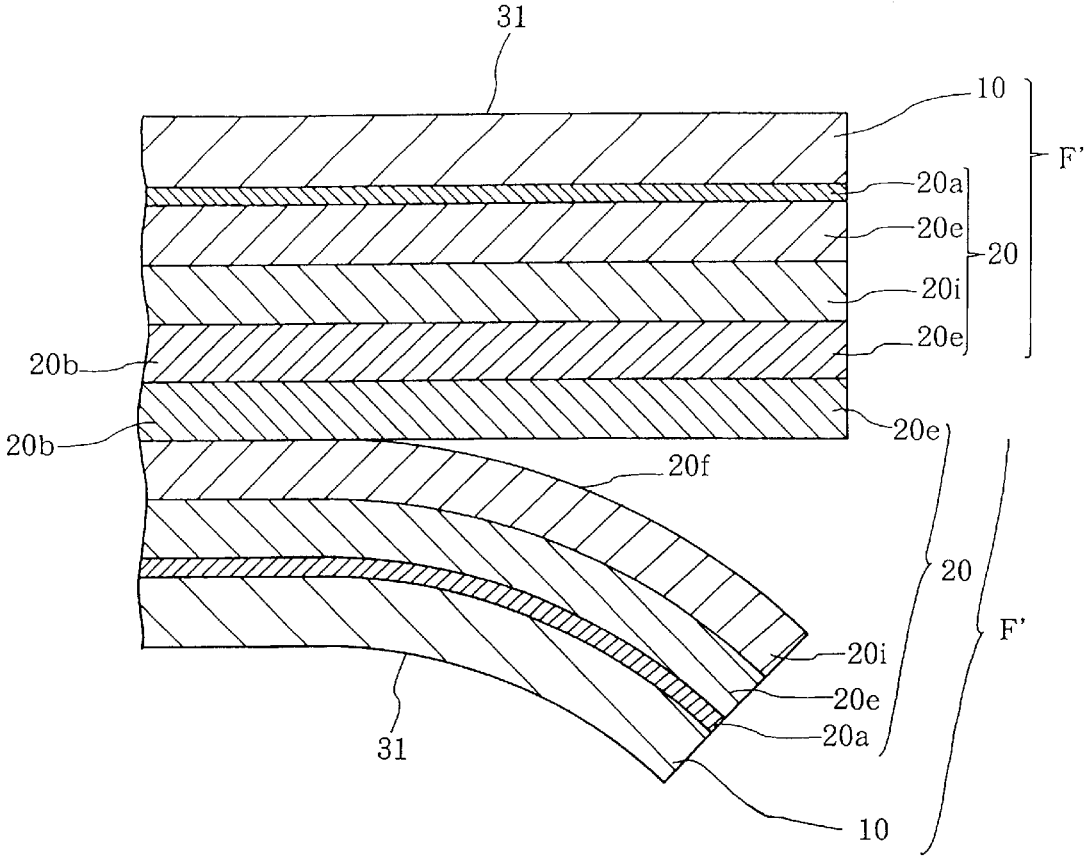
FIG. 24 is a cross-sectional view illustrating an important portion of a package bag W produced by the packaging device S.
Figure 25:
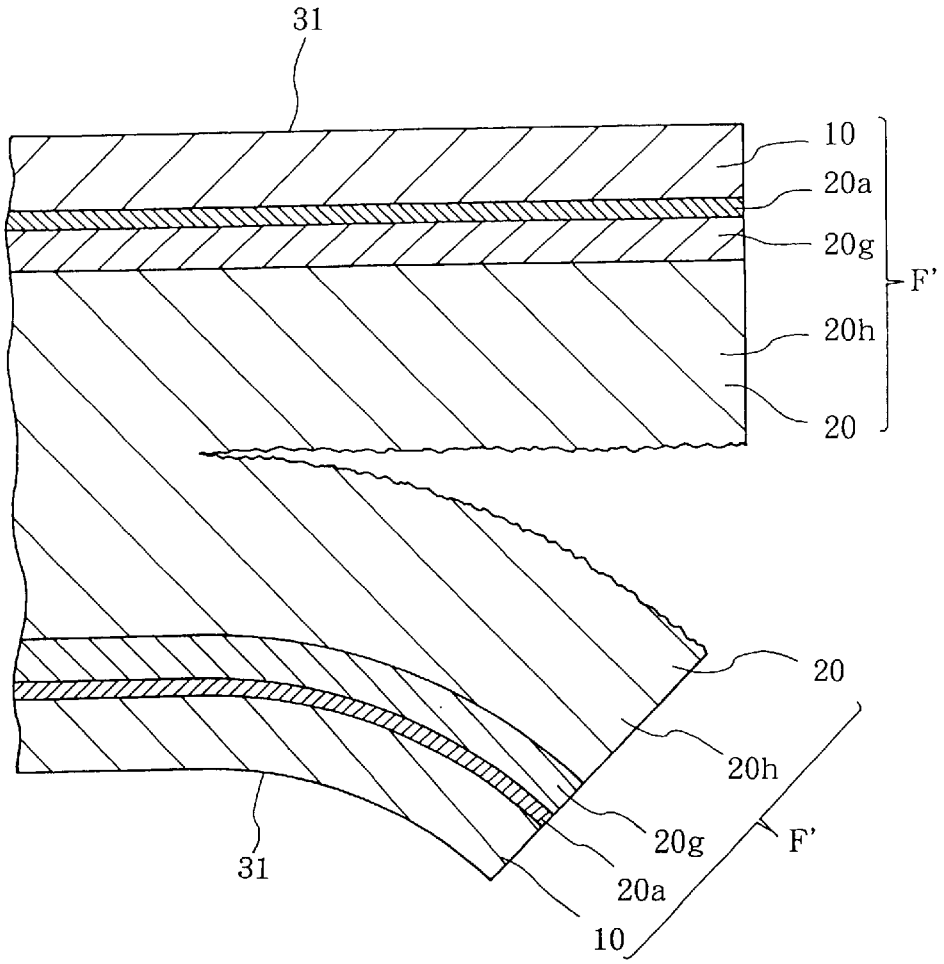
FIG. 25 is a cross-sectional view illustrating an important portion of a package bag W produced by the packaging device S.

FIGS. 17 through 20 respectively illustrate various modes of a package bag H formed by the packaging device S according to the embodiment, wherein shapes of a thermally sealed portion 30 like a waved belt or a V belt are different respectively in the modes of the package bag illustrated in these Figures. FIGS. 21 and 22 are perspective views illustrating the package bag H in the mode illustrated in FIG. 17. Particularly, in FIG. 22, a state that films 31, 31 on both surfaces of the package bag H are pulled in directions of separating each other through stripping margins is shown. FIGS. 23 through 25 are constitutional cross-sectional views of a part of the thermally sealed portion 30 in case that a tensile force is applied to the thermally sealed portion 30 as illustrated in FIG. 22, wherein FIG. 23 shows interfacial peeling; FIG. 24 shows ply separation; and FIG. 25 shows cohesive failure.

The packaging device S according to the embodiment continuously provide first thermally sealed portions 30' in a continuous film F' having a sealant layer 20, which is fusion-bonded so as to cause interfacial peeling, ply separation, or cohesive failure on a surface thereof, which continuous film F' is conveyed after being doubled toward the sealant layer 20, along a conveying direction x of the continuous film F'. The packaging device S also continuously forms package bags H, enclosing objects to be packed W between adjacent two second thermally sealed portions 30", 30", provided in directions perpendicular to the conveying direction x with a predetermined interval.

For example, the continuous film F' causing such interfacial peeling is formed by integrally providing a sealant layer 20, fabricated by an inextensible plastic layer 20*e*, an adhesive film layer 20*i*, and an unextensible plastic layer 20*e* arranged from an inside to an outside, through an adhesive layer 20*a* on a surface of a base film 10 formed by stretching a plastic. By providing the thermally sealed portion 30 at a temperature of avoiding to firmly fusion-bond a plastic layer 20*b*, making the sealant layer 20 on an upper surface of one of the film portions 31 of the doubled continuous film F', to a plastic layer 20*b*, making the sealant layer 20 on an upper surface of the other film portion 31 of the doubled continuous film F', it is possible to separate the film portions 31, 31 by pulling these in directions of separating each other to break the thermally sealed portion 30 at an interface 20*c*, as illustrated in FIG. 23.

For example, the continuous film F' causing such ply separation is formed by integrally providing a sealant layer 20, fabricated by an inextensible plastic layer 20*e*, an adhesive film layer 20*i*, and an inextensible plastic layer 20*e* arranged from an inside to an outside, through an adhesive layer 20*a* on a surface of a base film 10 formed by stretching a plastic. By providing the thermally sealed portion 30 at a temperature of firmly fusion-bonding a plastic layer 20*b*, making a sealant layer 20 on an upper surface of one of film portions 31 of the doubled continuous film F' to a plastic layer 20*b*, making the sealant layer on an upper surface of the other film portion 31 of the doubled continuous film F', it is possible to separate the film portions 31, 31, by pulling the film portions 31, 31 in directions of separating each other to break the thermally sealed portion 30 at an interlayer 20*f* between one of the adhesive film layers 20*i*, making the sealant layer 20 in one of the films 31, and the inextensible plastic layer 20*e*.

For example, the continuous film F' causing such cohesive failure is formed by providing an aluminum foil 20*g* through an adhesive layer 20*a* on one surface of a base film 10, formed by stretching a plastic, and also by providing a sealant layer 20, made of a fusion bondable bonding layer 20*h* causing the cohesive failure, on an upper surface of the aluminum foil 20*g*. In this case, it is possible to cause the cohesive failure at the bonding layer 20*h*, which is fusion-bonded in the thermally sealed portion 30 of the both film portions 31, 31, 31 by pulling the films 31, 31 in directions of separating each other, whereby the film portions 31, 31 are separated by breaking the thermally sealed portion 30, as illustrated in FIG. 25.

As illustrated in FIG. 12, the packaging device S according to the embodiment as constructed above continuously forms the package bags H from the continuous film F', as a raw fabric film.

In FIG. 12, numerical reference 50 designates a raw fabric roll of the continuous film F'. Numerical reference 60 designates a guide roll for guiding to draw the continuous film F' from the raw fabric roll 50. Numerical reference 70 designates a doubling means, which doubles the drawn out continuous film F' along a longitudinal direction. The doubling means 70 is shaped like a frame, composed of a U-shape member 71 and a straight member 72, connected to ends of the U-shape beam so as to bridge the ends. The continuous film F' is doubled by passing through an inside of the doubling means such that the continuous film is bent at a curved portion of the U-shape member along a curvature of the U-shape member.

A first thermally sealing means 80 for continuously providing the first thermally sealed portion 30' in an edge 33, opposite to the bent side 32 of the doubled and conveyed continuous film F', is arranged just below the doubling means 70. A second thermally sealing means 90 for intermittently providing the second thermally sealed portions 30" in a width direction of the continuous film F' with a predetermined interval is arranged further below the first thermally sealing means 80.

In the embodiment, the first thermally sealing means 80 includes a pair of thermal rolls (hereinbelow, referred to as longitudinal thermal rolls 81), of which rotating axes are arranged in directions perpendicular to the conveying direction x of the continuous film F'; and the second thermally sealing means 90 includes a pair of thermal rolls (hereinbelow, referred to as lateral thermal rolls 91), of which rotating axes are arranged in directions perpendicular to the conveying direction x of the continuous film F'.

The pair of the longitudinal thermal rolls 81, 81, respectively includes an annular protrusion 82, shaped like a flange, in one end thereof for drawing and sending the continuous film F' and for continuously providing the first thermally sealed portion 30' in an edge 33, opposite to the bent side 32 of the doubled continuous film F' along the conveying direction of the continuous film F'.

Further, the pair of the longitudinal thermal rolls 81, 81, respectively includes an annular protrusion 83, shaped like a flange in the other ends thereof.

The paired longitudinal thermal rolls 81, 81 are adversely rotated each other such that the protrusions 82 in the one end are closely arranged and the protrusions 83 in the other end are also closely arranged on facing sides of the longitudinal thermal rolls; and the doubled continuous film F' is drawn from a side of the doubling means 70 into a space among the protrusions 82 and the protrusions 83 and sent toward the lateral thermal rolls.

In the embodiment, the protrusions 82 are in contact with the longitudinal film F' with a pressure so that an unsealed portion 34 is formed between the sealed portion 30 and a film edge 35 along the conveying direction x of the continuous film F'.

In this embodiment, the protrusions 82 are formed so that the films 31, 31 of the continuous film F' are nipped at a position, a little closer to the bent side 32 of the continuous film F' from the film edge 35 of the bent continuous film F'. Further, as illustrated in FIG. 14, the continuous film F' is transferred between the paired longitudinal thermal rolls 81, 81 in a state that the film edge 35 of the continuous film F' is outward protruded from the protrusions 82 in the one end.

In this embodiment, one of the protrusions 82 is a rib-like protrusion 82*a*, formed in a substantially zigzag-like shape along a rotational direction of a corresponding longitudinal thermal roll 81.

The rib-like protrusion 82*a* includes V portions 82*b*, which are formed around the rotational direction of the longitudinal thermal roll 81 with substantially same intervals so as to direct the one end of the longitudinal thermal roll 81, and valley-like portions respectively arranged between the V portions 82*b*, wherein the rib-like protrusion 82*a* is in a zigzag belt-like shape. In FIG. 15, an example that peaks 82*c* of the V portions 82*b* are sharpened is shown.

Because of such a structure, it is possible to continuously provide the first thermally sealed portion 30' to be in a zigzag belt-like shape or a wave belt-like shape under a state that the unsealed portion 34 is formed between the film edge 35 of the continuous film F' and the first thermally sealed portion 30' in the edge 33 opposite to the bent side 32 of the doubled and conveyed continuous film F'.

Thereafter, by providing the second thermally sealed portions 30" in the continuous film F' provided with the first thermally sealed portion 30' by the pair of the lateral thermal rolls 91, 91, the package bag H, of which inner space is sealed by the first thermally sealed portion 30 along the conveying direction x of the continuous film F' and by the pair of the second thermally sealed portions 30" along a direction perpendicular to the conveying direction x, can be continuously formed.

More specifically, in the embodiment, the paired longitudinal thermal rolls 81, 81 are metallic shafts, both end of which are supporting portions 84 supported by a frame 85. In FIG. 14, numerical references 86 designate bearing bodies, in which bearings are housed, wherein the supporting portions 84 on the both ends of the pair of the longitudinal thermal rolls 81, 81 are assembled so that the supporting portions 84, 84 are rotatably supported by the bearings. Supporting spaces 85*a* for slidably housing the bearing bodies 86 are formed in the frame 85. A compression coil spring 85*b* is interposed between the bearing body 86 for supporting one side of one of the pair of the longitudinal thermal rolls 81, 81 and the bearing body 86 for supporting the other side thereof. Pressing screws 85*c* for pushing against urging of the spring 85*b* so that the paired longitudinal thermal rolls 81, 81 approach each other is provided in the frame 85. Tips of the pressing screws 85*c* are in contact with one of the bearing bodies 86 on an opposite side to a side in contact with the compression coil spring 85*b* to enable adjustment of an interval between the pair of the longitudinal thermal rolls 81, 81 by turning the compression coil spring 85*c*.Further, ends of the paired longitudinal thermal rolls 81, 81 on one side thereof, which ends are protruding from the bearing bodies 86, are provided with gears 87 mutually engaged. In a tip closer to the end than the gear 87 of one of the paired longitudinal thermal rolls 81, 81, a bevel gear 88*b* is provided so as to engage with a bevel gear 88*a* on an actuator side, wherein the longitudinal thermal roll 81 is rotated when the bevel gear 88*a* on the actuator side rotates, and the other longitudinal thermal roll 81 is adversely rotated by the engaging gears 87. The paired longitudinal thermal rolls 81, 81 have inner spaces, opened to an outside, on ends opposite to the side where the gears 87 are assembled. A rod-like heater 89 for heating the longitudinal thermal rolls 81 is respectively inserted from the opening ends of the longitudinal thermal rolls 81.

Further, in the embodiment, the protrusions 83, 83 of the pair of the longitudinal thermal rolls 81, 81 form the thermally sealed portion 30, having a predetermined width on the bent side 32 of the continuous film F', along the conveying direction x of the continuous film F'.

As an technical application, in both of the paired longitudinal thermal rolls 81, 81, the protrusions 82, 82 may be rib-like protrusions in the zigzag belt-like shape for providing the first thermally sealed portion 30' in the edge 33 on the opposite side to the bent side 32 of the continuous film F'.

Further, one or more protrusions may be provided between the protrusions 82, 83 so that these protrusions of the longitudinal thermal rolls 81, 81 face each other, whereby one or more thermally sealed portions 30 are formed between the bent side 32 and the edge 33 opposite thereto of the continuous film F' to section an enclosing space of the package bag into a plurality of areas.

In the next, the paired lateral thermal rolls 91, 91 respectively include sealing portions 92, protruded along a direction of a rotational axis of the lateral thermal roll 91, wherein the sealing portions 92 draw and send the continuous film F', having the first thermally sealed portion 30' formed by the pair of the longitudinal thermal rolls 81, 81, and sequentially provide the second thermally sealed portions 30" with predetermined intervals.

In this embodiment, the lateral thermal rolls 91 respectively have outer flanges 93 in both ends thereof and the sealing portions 92 between the outer flanges 93. The plurality of the sealing portions 92 are formed with intervals in a rotating direction of the lateral thermal rolls 91. The sealing portions 92 of one of the pair of the lateral thermal rolls 91, 91 are closely arranged so as to sequentially meet the sealing portions 92 of the other lateral thermal roll 91 on a side facing the other lateral thermal roll 91 along the rotation of the lateral thermal roll 91. The continuous film F' drawn between the paired lateral thermal rolls 91, 91 is intermittently provided with the second thermally sealed portions 30" by the sealing portions 92.

In the embodiment, recesses 94 are formed in the sealing portions 92 of the paired lateral thermal rolls 91, 91 on a side close to an edge 33, opposite to the bent side 32 of the continuous film F', so that the second thermally sealed portions 30" are formed at positions corresponding to the unsealed portion 34, and so that ends 36 of the second thermally sealed portions 30" are substantially included in the zigzag-like first thermally sealed portion 30, formed by the rib-like protrusions 82*a* of the longitudinal thermal rolls 81.

Further, in the embodiment, the object to be packed W, enclosed in the formed package bag H, is filled among the pair of the longitudinal thermal rolls 81, 81 and the pair of the lateral thermal rolls 91, 91.

An angled nozzle 100 for continuously or intermittently supplying the object to be packed W from a filling device is introduced into an inside of the continuous film F' from a position just below the doubling means on a side opposite to the bent side 32 of the doubled continuous film F' and led between the pair of the longitudinal thermal rolls 81, 81. A discharge port 101 of the nozzle 100 is arranged at a position above the pair of the lateral thermal rolls 91, 91. A predetermined quantity of the object to be packed W is supplied between the priority provided second thermally sealed portion 30" and the succeedingly provided second thermally sealed portion 30". Thus, the package bags H, enclosing the object to be packed W, are continuously and sequentially formed.

Further, two sets of choking rollers 110, 110, of which rotational axes are arranged in directions perpendicular to the conveying direction x of the continuous film F', are vertically arranged between the discharge port 101 of the nozzle 100 and the pair of the lateral thermal rolls 91, 91, whereby the continuous film F' passes through the two sets of the choking rollers 110, 110 to remove an air and so on, contained in the object to be packed W, by the choking rollers 110 before sealing by the pair of the lateral thermal rolls 91, 91.

Further, at a position succeeding to the pair of the lateral thermal rolls, a pair of equalizing rollers 120, 120, of which rotational axes are arranged in directions perpendicular to the conveying direction x of the continuous film F', are provided so that the continuously formed package bags H pass through the pair of the equalizing rollers 120, 120, whereby a state that the object to be packed W is evenly enclosed in an entire enclosing space of the package bag H is realized by the equalizing rollers 120.

In a succeeding position to the pair of the equalizing rollers 120, 120, leading rollers 130, 130 for conveying the continuously formed package bags H are provided. In a succeeding position to the leading rollers 130, 130, a cutting means 140 for cutting the second thermally sealed portions 30" is provided in these width directions to separate into individual package bags H. The cutting means 140 includes a fixed plate 141 and a rotary blade 142 for cutting in collaboration with the fixed blade 141. Instead of the cutting means 140, a perforating means may be provided for perforating the second thermally sealed portions 30" in these width directions.

Because the packaging device S according to the embodiment has the above structure, the rectangular-like package bags H, in which the objects to be packed W are respectively enclosed among the pair of the second thermally sealed portions 30", 30" and the first thermally sealed portion 30', positioned between the pair of the second thermally sealed portions 30", 30", can be continuously formed.

Further, the first thermally sealed portion 30' is formed in the zigzag belt-like shape while leaving the unsealed portion 34 as the stripping margins 37 between the first thermally sealed portion 30' and the film edge 35 in one of the sides of the package bag. Hereinbelow, the thermally sealed portion 30, including the first thermally sealed portion 30' in the zigzag belt-like shape, is referred to as a strippable seal. A shape of the strippable seal 40*a*, it is possible to modify the V-like portions 40*b*, and so on of the package bag H by changing a shape of the rib-like protrusions 82*a* of the lateral thermal rolls 81.

As illustrated in FIGS. 17 through 22, the unsealed portion 34 with a sufficient width for picking up the film edges 35 is formed between the film edges 35 and the strippable seal 40*a* along the side 40 of the package bag H; the unsealed portion 34 is connected to the strippable seal 40*a*; and the second thermally sealed portions 30" positioned on both sides of the strippable seal 40*a* are formed so that the side ends 36 of the second thermally sealed portions 30" substantially overlap the width of the strippable seal 40*a*.

As a result, when the stripping margins 37 formed in the side 40, the stripping margins 37 adjacent to the strippable seal 40*a* are pulled in directions of separating the films 31, 31, wherein such a tensile force is concentrated on the peaks of the V-like portions 40*b* of the strippable seal 40*a*, whereby a part of the strippable seal 40*a* is broken with a relatively small tensile force by the interfacial pealing, the ply separation, or the cohesive failure. Thus partly broken strippable seal 40*a* is then easily broken in a continuous manner from the broken portion to the other side by a continuous application of the tensile force. Also, the second thermally sealed portions 30" positioned on the both sides of the strippable seal 40*a*, which overlaps the ends of the second thermally sealed portions 30", are easily broken in a sequential manner from the ends 36 by the continuous application of the tensile force.

As illustrated in FIG. 22, when the film portions 31, 31 of the package bag H, produced by the packaging device S, are pulled in the directions of separating these through the stripping margins 37, the three thermally sealed portions 30', 30", 30", respectively in the side 40 provided with the strippable seal 40*a* and the sides 40, 40 on both sides of the side 40 of the rectangular-like package bag H can be relatively easily broken, whereby the film portions 31, 31 are easily separated to an extent necessary for taking out the object to be packed W.

In the next, another example of the embodiment of the packaging device according to the present invention will be described in reference of FIGS. 26 through 29.

Figure 26:
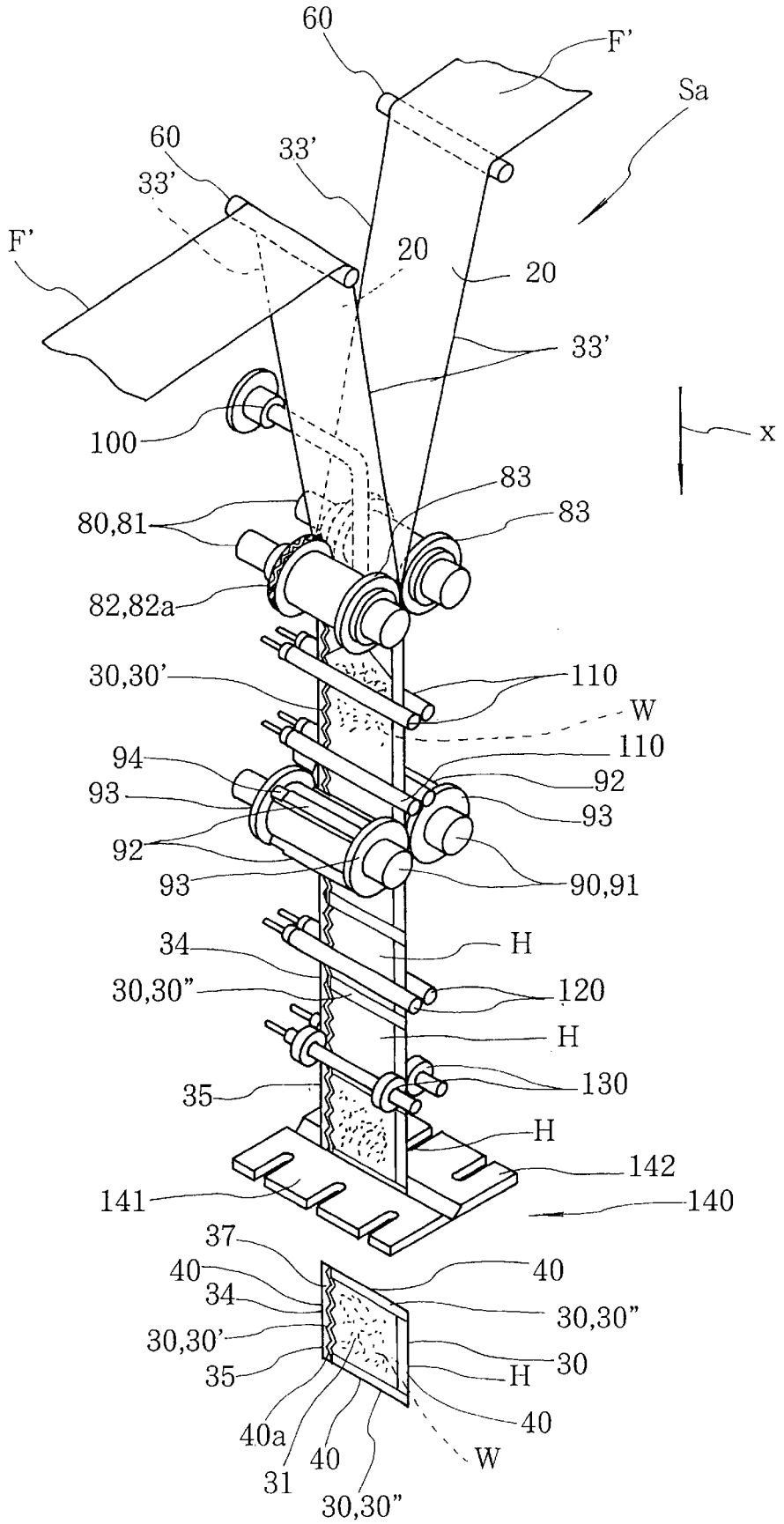
FIG. 26 is a perspective view illustrating a structure of a packaging device Sa.
Figure 27:
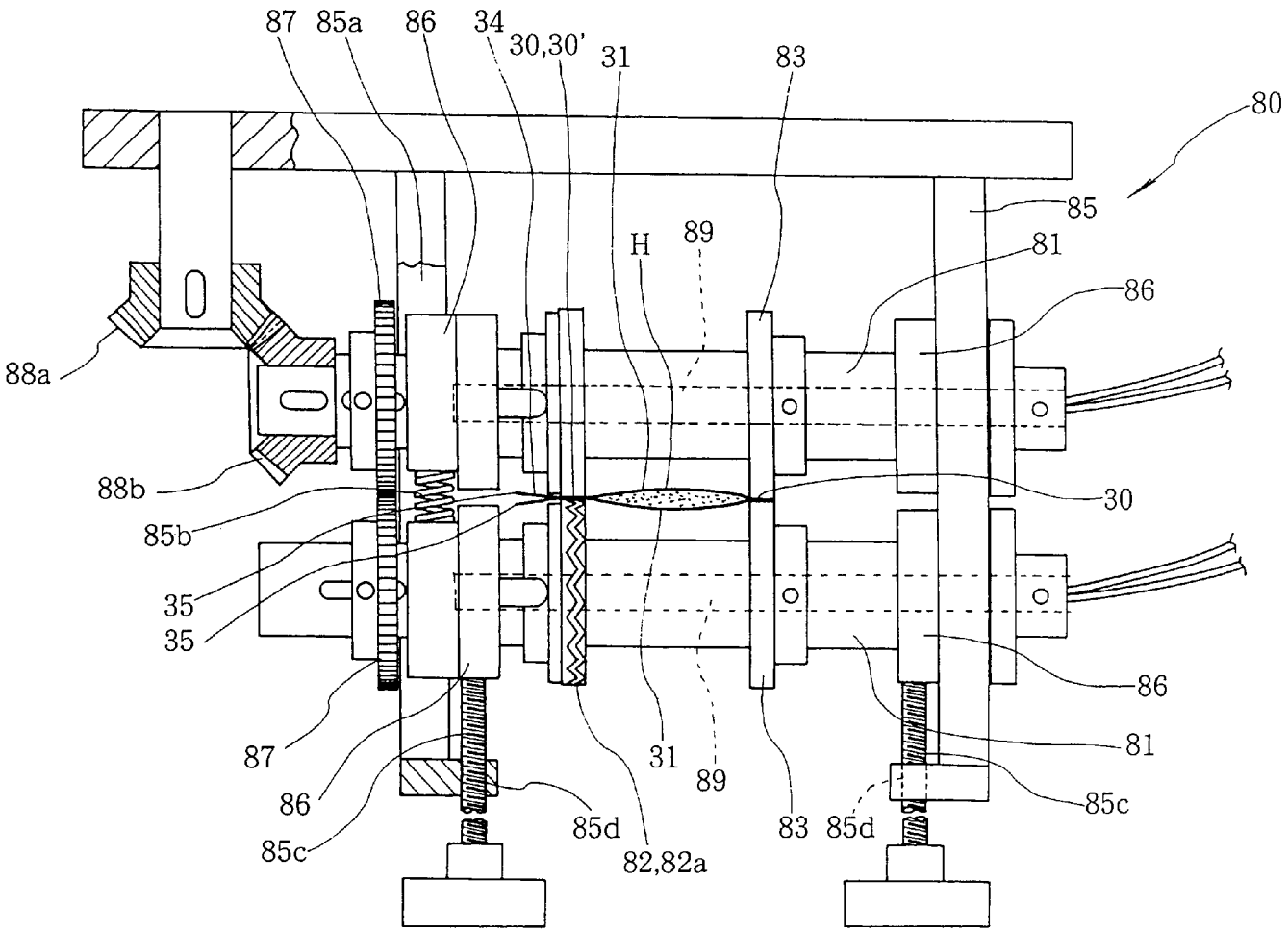
FIG. 27 is a plan view illustrating an important portion of the packaging device Sa.
Figure 28:
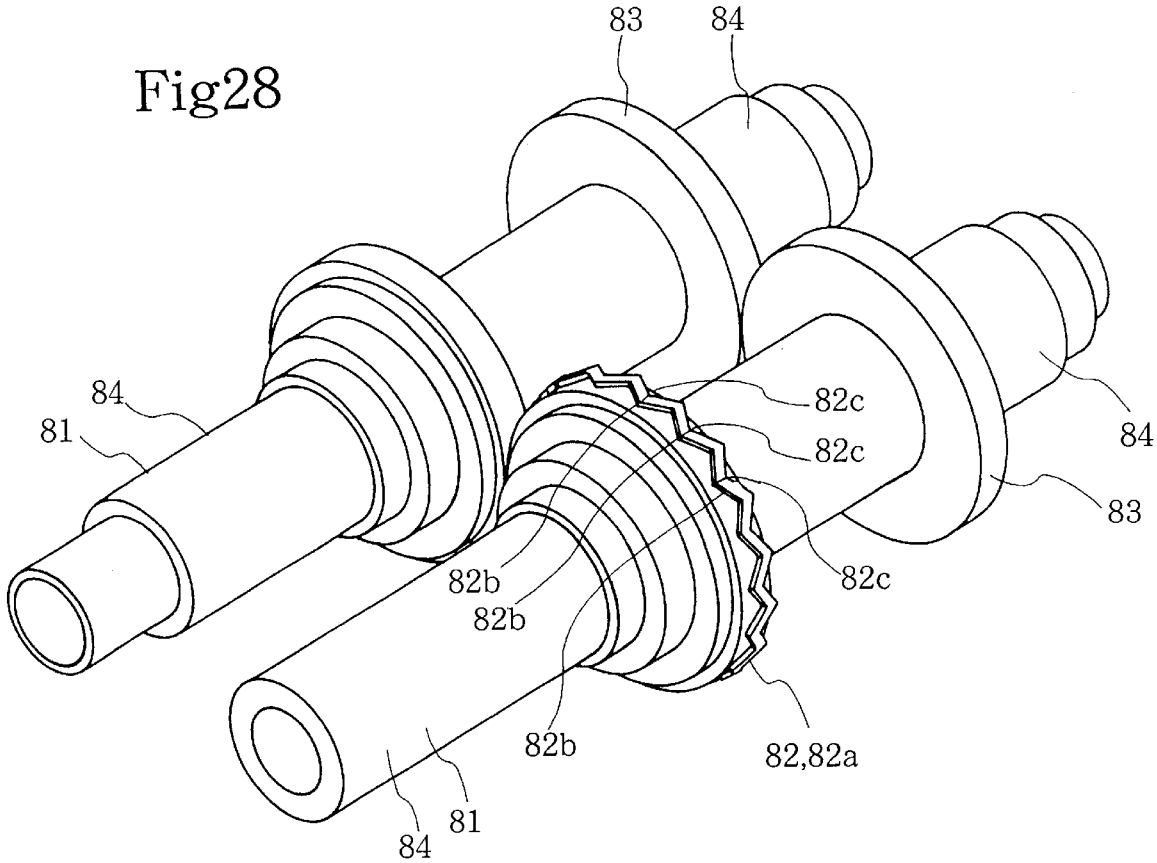
FIG. 28 is a perspective view illustrating longitudinal thermal rolls 81 constructing the packaging device Sa.
Figure 29:
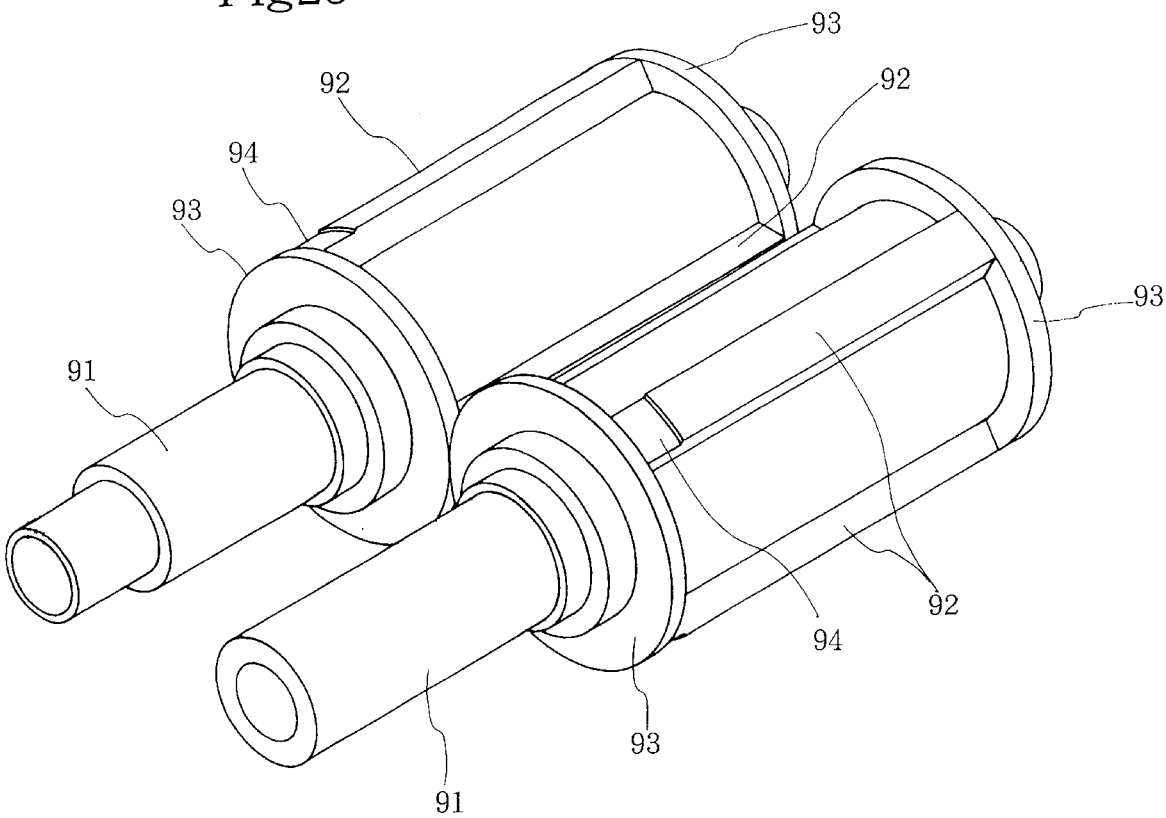
FIG. 29 is a perspective view illustrating a structure of lateral thermal rolls 91 constructing the packaging device Sa.

FIG. 26 is a perspective view of an important portion of an entire structure of a packaging device Sa according to the embodiment. FIG. 27 is a plan view of a first thermal roll means 80 of the packaging device Sa by partly removing it for understanding. FIG. 28 is a perspective view of a pair of longitudinal thermal rolls 81, 81 configuring the first thermal roll means. FIG. 29 is a perspective view of a pair of lateral thermal rolls 91, 91 configuring a second thermal roll means 90 of the packaging device Sa.

The packaging device Sa produces package bags H, enclosing an object to be packed W among first thermally sealed portions 30' and adjacent two second thermally sealed portions 30", 30", wherein the first thermally sealed portions are continuously provided along a conveying direction of x two continuous films F', F', which continuous films F', F' respectively including a sealant layer 20 to be fusion-bonded on one surface thereof so as to occur interfacial peeling, ply separation, or cohesive failure; the two continuous films F', F' are conveyed with surfaces having the sealant layers 20 faced each other; and the second thermally sealed portion 30" is provided with a predetermined interval along directions perpendicular to the conveying direction x.

In the embodiment, for example, the continuous films F', F' are two sheets of raw fabric roll. The continuous films are conveyed with the sealant layers 20 faced each other and provided with the first thermally sealed portions 30' in at least one of side edges 33', 33' along the conveying direction x, whereby a strippable seal 40*a* is formed in at least one of sides 40 of the package bag H in a rectangular-like shape.

For producing such a package bag H, the packaging device Sa is constructed such that one of annular protrusions 82, formed on both sides of the paired longitudinal thermal rolls 81, 81, works to form the first thermally sealed portion 30' in the one of the side edges 33' of the conveyed two continuous films F', F' while leaving an unsealed portion 34 between the first thermally sealed portion 30' and a film edge 35, and the other annular protrusions 83, formed on the other sides of the paired longitudinal thermal rolls 81, 81 continuously provide a thermally sealed portion 30 in the other side edge 33' of the conveyed two continuous films F', F' along the conveying direction x of the continuous films F'.

Resultantly, as illustrated in FIG. 26, the package bag H is provided with the thermally sealed portions 30, 30, . . . in four sides 40, 40, . . . thereof for enclosing the object to be packed W.

One or both of the other protrusions 83 of the pair of the longitudinal thermal rolls 81, 81 may be a rib-like protrusion in a substantially zigzag-like shape like 82*a* along a rotational direction of the thermal roll 81 to further make the thermally sealed portion, provided in the side edges 33', a strippable seal 40*a*.

Since a structure of portions other than those described above in the packaging device Sa illustrated in FIGS. 26 through 29 is the same or substantially the same as that of the packaging device S illustrated in FIGS. 12 through 25, the same numerical references as those in FIGS. 12 through 25 are used for the same or substantially the same structural elements. Therefore, description of numerical references is omitted.

In the next, another example of the embodiment of the packaging device according to the present invention will be described in reference of FIGS. 30 through 33.

Figure 30:
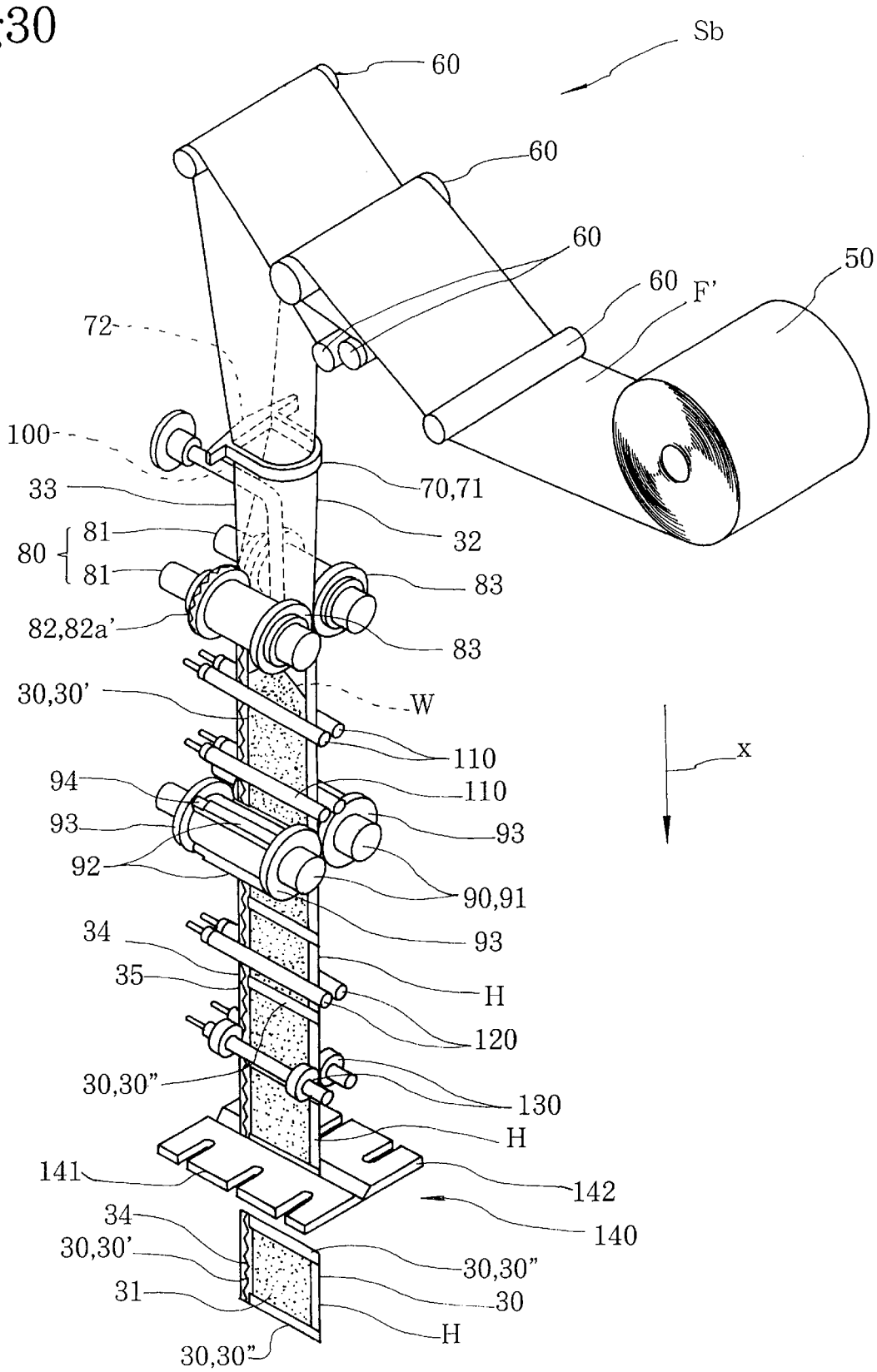
FIG. 30 is a perspective view for illustrating a structure of a packaging device Sb.
Figure 31:
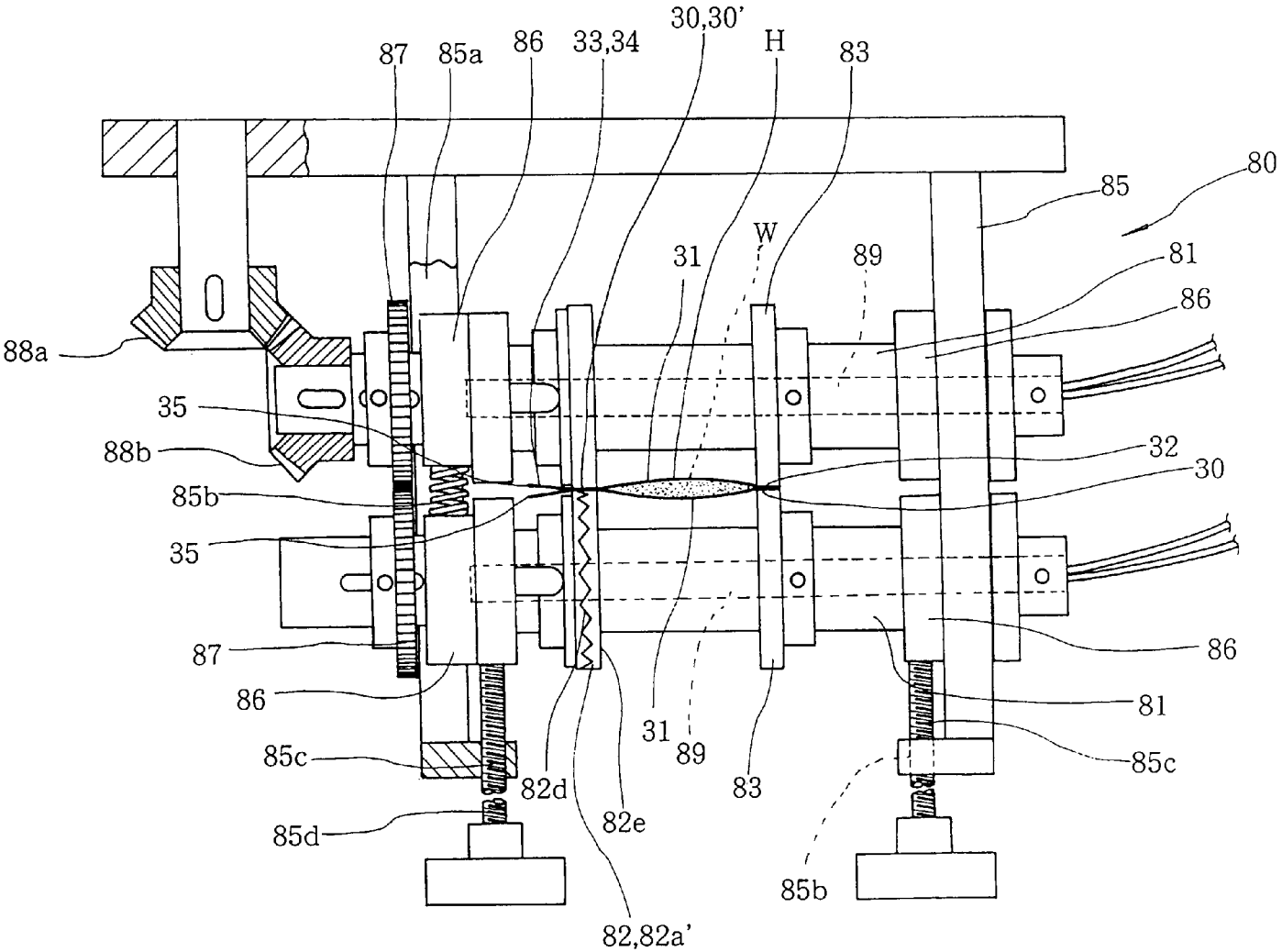
FIG. 31 is a plan view illustrating an important portion of the packaging device Sb.
Figure 32:
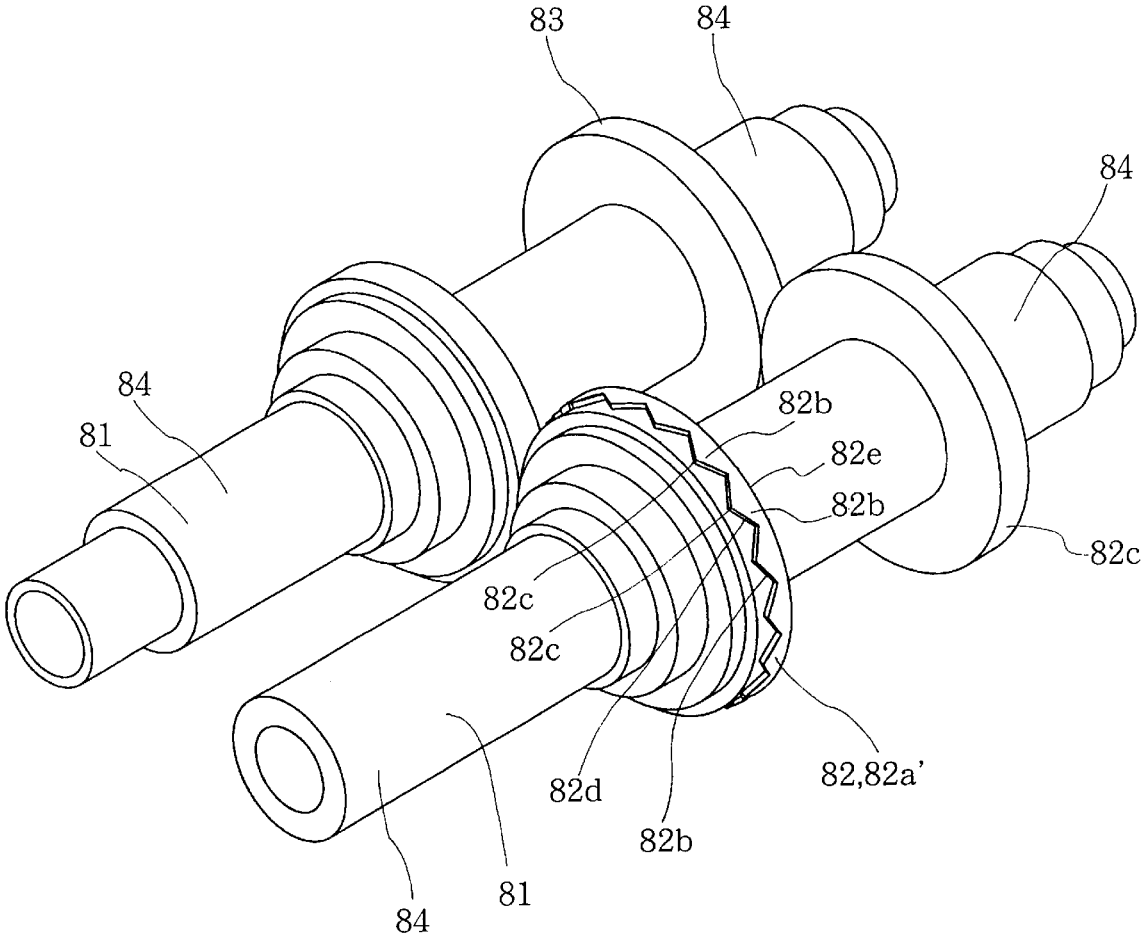
FIG. 32 is a perspective view illustrating longitudinal thermal rolls 81 constructing the packaging device Sb.
Figure 33:
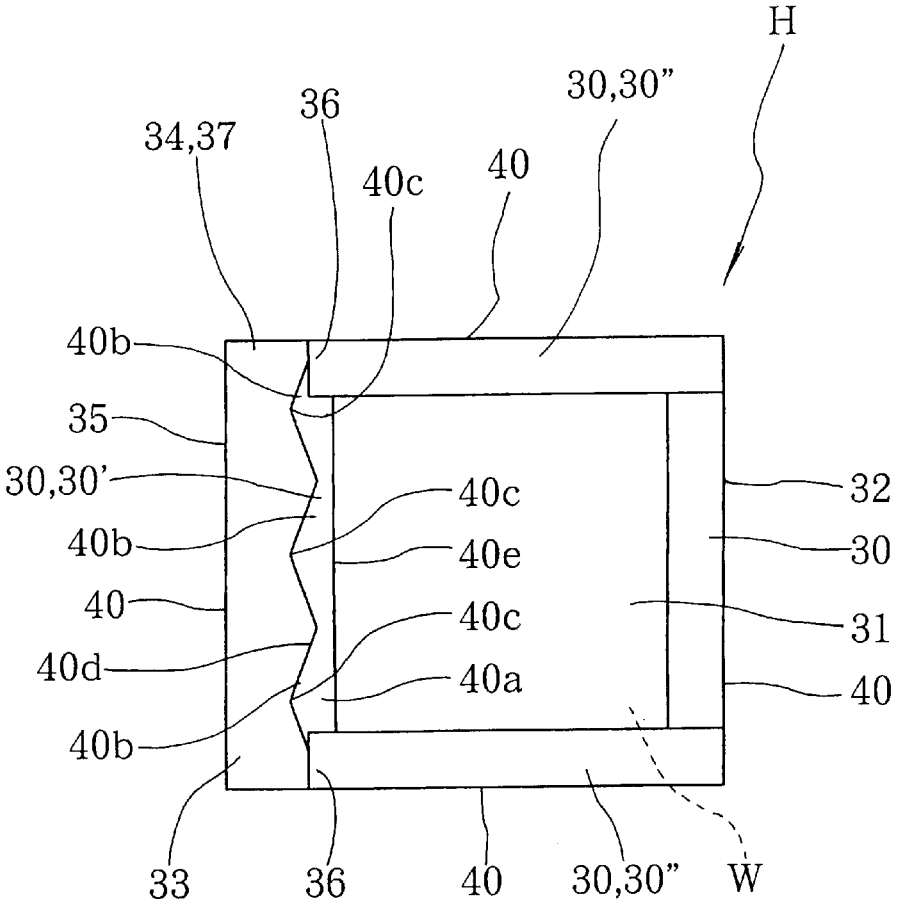
FIG. 33 schematically illustrates a package bag W formed by the packaging device Sb.

FIG. 30 is a perspective view of an important portion of an entire structure of a packaging device Sb according to the embodiment. FIG. 31 is a plan view of a first thermal roll means 80 of the packaging device Sb by partly omitting for understanding. FIG. 32 is a perspective view of a pair of longitudinal thermal rolls 81, 81, constructing the first thermal roll means 80. FIG. 33 illustrate a structure of an example of a package bag, produced by packaging device Sb.

A structure of the pair of the longitudinal thermal rolls 81, 81 of the packaging device Sb is different from that of the packaging device S illustrated in FIGS. 12 through 16. In the embodiment, one of protrusions 82 on the sides of the pair of longitudinal thermal rolls 81, 81 includes a zigzag edge 82*d* in a substantially zigzag like shape along a rotational direction of the longitudinal thermal roll 81, provided on a side of a film edge 35 opposite to a bent side 32 of a doubled and conveyed continuous film F' and also includes a rib-like protrusions 82*a*', of which edge on the bent side 32 is a straight edge 82*e*.

As a result, as illustrated in FIG. 30, an edge of a sealed portion on the side of the film edge 35 is formed in a wave-like shape by processing the first thermal seal portion 30, using the rib-like protrusion 82*a* under a state that an unsealed portion 34 is formed between the film edge 35 of the continuous film F' and the first thermal seal portion 30, on a side 33, opposite to the bent side 32 of the doubled and conveyed continuous film F', and a thermally sealed portion 30' on the opposite side to the film edge 35 is continuously formed to have a straight sealing edge.

Accordingly, it is possible to continuously produce the package bag H, wherein an edge 40*d* of a strippable seal 40*a* on the side of the film edge 35 of the unsealed portion 34, being a stripping margin 37, is shaped like a wave; on edge 40*e* of the first thermally sealed portion in an inside of the package bag H, is formed to be straight; and edges of the other thermally sealed portions 30 in the inside of the package bag corresponding to the sides 40 are formed to be straight. In case that an object to be packed W, filled in a process of forming the package bag H, changes from a soft condition to a hard condition with time or changes by a heat treatment or the like, the filled object to be packed in the soft condition is formed in a plate-like and substantially rectangular-like shape in the package bag H upon hardening.

A structure of portions, other than the above of the packaging device Sb according to the embodiment illustrated in FIGS. 30 through 33, is the same or substantially the same as that of the packaging device S illustrated in FIGS. 12 through 25. Constitutional elements, the same or substantially the same as those in the packaging device S, are referred to as by the same numerical references as those in FIGS. 12 through 25, and description is omitted.

The first advantage of the package bag according to the present invention is that the package bag is relatively easily opened by applying the tensile force.

The second advantage of the package bag according to the present invention is that the both surfaces of the package bag are easily pulled for opening.

The third advantage of the package bag according to the present invention is that the object to be packed is stably enclosed in an occasion that the package bag is not opened because although a sealed state is relatively firmly maintained, the package bag is opened with less trouble.

The fourth advantage of the packaging device according to the present invention is that the appropriate package bags are continuously produced while sequentially enclosing the objects to be packed therein.

Obviously, numerous modifications and variations of the present invention are possible in light of the above teachings. It is therefore to be understood that within the scope of the appended claims, the invention may be practiced otherwise than as specifically described herein.

What is claimed is:

1. A package bag for enclosing an object to be packed, which package bag comprises a film having an easily peelable fusion bonded sealant layer, and thermally sealed side portions to enclose the object to be packed in the package bag, wherein at least one of said thermally sealed side portions along one of said sides is a strippable seal which is associated with an unsealed portion forming stripping margins positioned between said strippable seal and a film edge; and wherein said strippable seal is formed in at least a part of said one of the thermally sealed side portions, has a wave-shape, and extends fully through another one of said thermally sealed side portions.

2. The package bag according to claim 1, wherein the film is fusion bonded to cause at least interfacial peeling.

3. The package bag according to claim 1, wherein the film is fusion bonded to cause at least ply separation.

4. The package bag according to claim 1, wherein the film is fusion bonded to cause at least cohesive failure.

5. The package bag according to claim 1, wherein the package bag is thermally sealed on at least three sides.

6. The package bag according to claim 1, wherein the package bag is thermally sealed on four sides.

7. A package bag for enclosing an object to be packed, which package bag comprises a film having an easily peelable fusion bonded sealant layer, and thermally sealed side portions to enclose the object to be packed in the package bag, wherein at least one of said thermally sealed side portions along one of said sides is a strippable seal which is associated with an unsealed portion forming stripping margins positioned between said strippable seal and an film edge; and wherein said strippable seal is formed in at least a part of said one of the thermally sealed side portions, has a V-like shape protruding toward said film edge, and extends fully through another one of said thermally sealed side portions.

8. The package bag according to claim 7, wherein the film is fusion bonded to cause at least interfacial peeling.

9. The package bag according to claim 7, wherein the film is fusion bonded to cause at least ply separation.

10. The package bag according to claim 7, wherein the film is fusion bonded to cause at least cohesive failure.

11. The package bag according to claim 7, wherein the package bag is thermally sealed on at least three sides.

12. The package bag according to claim 7, wherein the package bag is thermally sealed on four sides.

* * * * *